US012527447B2

(12) United States Patent
Ohm et al.

(10) Patent No.: US 12,527,447 B2
(45) Date of Patent: Jan. 20, 2026

(54) MOBILE CLEANING ROBOT WITH VARIABLE CLEANING FEATURES

(71) Applicant: iRobot Corporation, Bedford, MA (US)

(72) Inventors: Timothy R. Ohm, Grover Beach, CA (US); Erik Amaral, Bolton, MA (US)

(73) Assignee: iRobot Corporation, Bedford, MA (US)

( * ) Notice: Subject to any disclaimer, the term of this patent is extended or adjusted under 35 U.S.C. 154(b) by 197 days.

(21) Appl. No.: 17/898,674

(22) Filed: Aug. 30, 2022

(65) Prior Publication Data

US 2024/0065498 A1 Feb. 29, 2024

(51) Int. Cl.

| | |
|---|---|
| ***A47L 9/00*** | (2006.01) |
| ***A47L 9/04*** | (2006.01) |
| ***A47L 9/14*** | (2006.01) |
| ***A47L 9/28*** | (2006.01) |

(52) U.S. Cl.

CPC ..... *A47L 9/0072* (2013.01); *A47L 9/0477* (2013.01); *A47L 9/1409* (2013.01); *A47L 9/149* (2013.01); *A47L 9/281* (2013.01); *A47L 9/2826* (2013.01); *A47L 2201/06* (2013.01)

(58) Field of Classification Search

None

See application file for complete search history.

(56) References Cited

U.S. PATENT DOCUMENTS

| | | | | |
|---|---|---|---|---|
| 2007/0101537 | A1* | 5/2007 | Rocke | A47L 9/0072 15/421 |
| 2014/0026338 | A1* | 1/2014 | Kim | A47L 9/0606 15/246.2 |
| 2016/0183752 | A1* | 6/2016 | Morin | A47L 9/127 15/340.1 |
| 2019/0000292 | A1* | 1/2019 | Rufenach | A47L 11/292 |
| 2021/0085144 | A1 | 3/2021 | Woodrow et al. | |
| 2021/0386262 | A1 | 12/2021 | Uchendu et al. | |

FOREIGN PATENT DOCUMENTS

| | | |
|---|---|---|
| EP | 2689701 | 1/2014 |

OTHER PUBLICATIONS

"International Application Serial No. PCT US2023 029941, International Search Report mailed Dec. 19, 2023", 3 pgs.
"International Application Serial No. PCT US2023 029941, Written Opinion mailed Dec. 19, 2023", 5 pgs.
"Chinese Application Serial No. 202322338726.3, Office Action mailed Apr. 25, 2024", w English translation, 3 pgs.

* cited by examiner

*Primary Examiner* — Kaj K Olsen
*Assistant Examiner* — Pradhuman Parihar
(74) *Attorney, Agent, or Firm* — Schwegman Lundberg & Woessner, P.A.

(57) ABSTRACT

A mobile cleaning robot can include a body movable within an environment and a debris bin located at least partially within the body. The robot can include a cleaning assembly connected to the body, where the cleaning assembly includes a first debris port connected to the debris bin and a second debris port connected to the debris bin.

13 Claims, 17 Drawing Sheets

MOBILE CLEANING ROBOT WITH VARIABLE CLEANING FEATURES

BACKGROUND

Autonomous mobile robots include autonomous cleaning robots that can autonomously perform cleaning tasks within an environment, such as a home. Many kinds of cleaning robots are autonomous to some degree and in different ways. The autonomy of mobile cleaning robots can be enabled by the use of a controller and multiple sensors mounted on the robot. In some examples, the robots can include devices for autonomously improving cleaning performance within an environment.

SUMMARY

As mobile cleaning robots (e.g., autonomous mobile cleaning robots) traverse an environment, the robots can perform cleaning operations such as vacuuming or mopping operations. During cleaning operations, the robot can operate a vacuum system, such as a blower (e.g., impeller and motor), and cleaning assembly (such as one or more rollers) to extract debris from the environment. However, because floor surfaces and debris types of the environment can vary, the vacuuming efficiency can vary between environments or between rooms of a given environment.

The devices, systems, and methods of this application can help to address these issues by providing a variable debris port that can be user-adjustable or automatically adjustable (e.g., via a controller of the robot) to improve vacuuming efficiency of the robot based on the flooring type. For example, the robot can include multiple suction ports that can be used during vacuuming operations in an environment. The suction or debris ports can be adjusted by the robot based on user input or based on floor type (e.g., automatically) to help improve cleaning efficiency between rooms and between environments.

For example, a mobile cleaning robot can include a body movable within an environment and a debris bin located at least partially within the body. The robot can include a cleaning assembly connected to the body, where the cleaning assembly includes a first debris port connected to the debris bin and a second debris port connected to the debris bin.

In another example, a method of operating a mobile cleaning robot can include determining a floor type of a floor surface of an environment. A location of the mobile cleaning robot within the environment can be determined. A first debris port and a second debris port of a cleaning assembly of the mobile cleaning robot can be adjusted.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
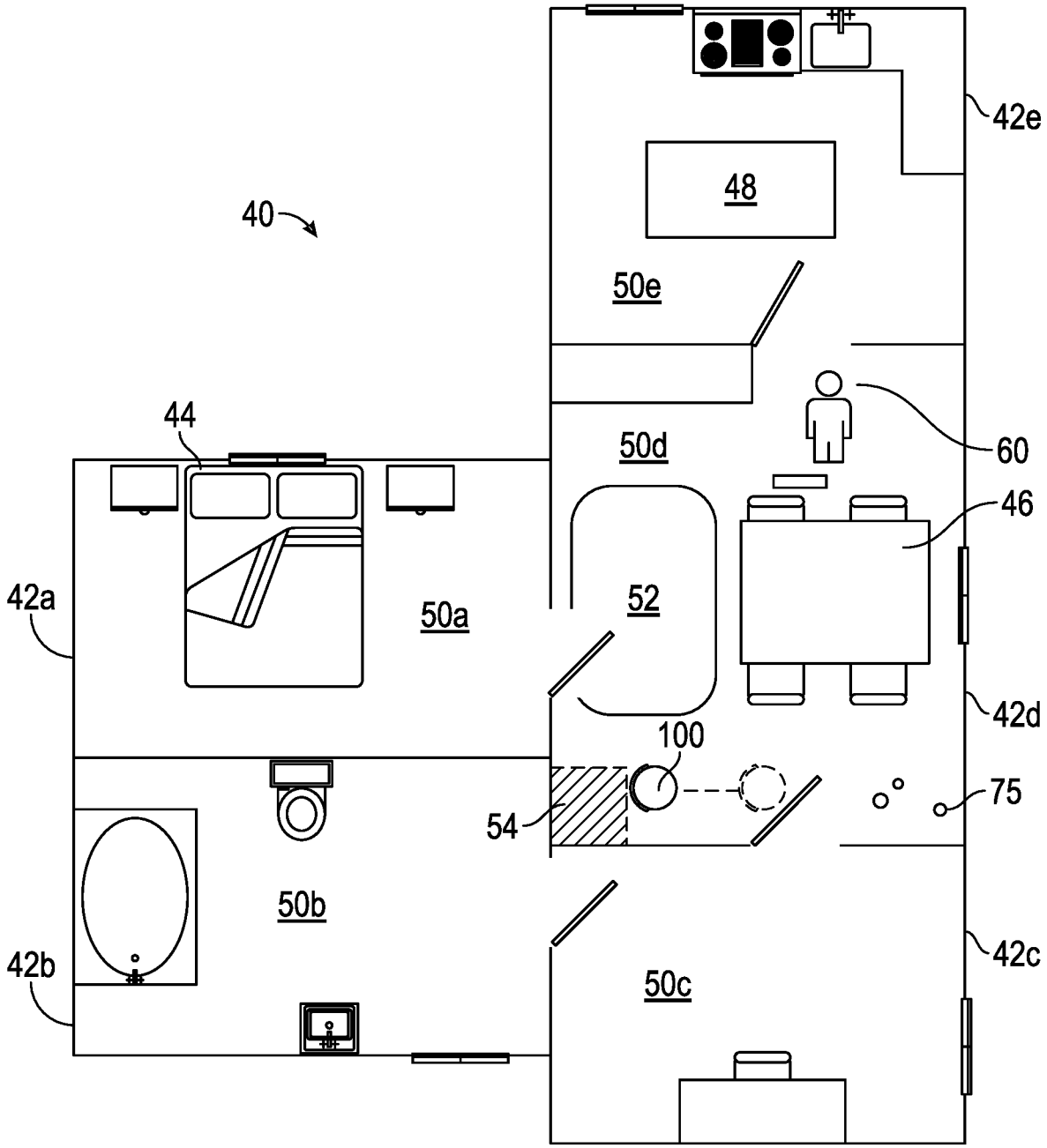
FIG. 1 illustrates a plan view of a mobile cleaning robot in an environment.

FIG. 1 illustrates a plan view of a mobile cleaning robot 100 in an environment 40, in accordance with at least one example of this disclosure. The environment 40 can be a dwelling, such as a home or an apartment, and can include rooms 42*a*-42*e*. Obstacles, such as a bed 44, a table 46, and an island 48 can be located in the rooms 42 of the environment. Each of the rooms 42*a*-42*e* can have a floor surface 50*a*-50*e*, respectively. Some rooms, such as the room 42*d*, can include a rug, such as a rug 52. The floor surfaces 50 can be of one or more types of flooring, such as hardwood, ceramic, low-pile carpet, medium-pile carpet, long (or high)-pile carpet, stone, or the like.

The mobile cleaning robot 100 can be operated, such as by a user 60, to autonomously clean the environment 40 in a room-by-room fashion. In some examples, the robot 100 can clean the floor surface 50*a* of one room, such as the room 42*a*, before moving to the next room, such as the room 42*d*, to clean the surface of the room 42*d*. Different rooms can have different types of floor surfaces. For example, the room 42*e* (which can be a kitchen) can have a hard floor surface, such as wood or ceramic tile, and the room 42*a* (which can be a bedroom) can have a carpet surface, such as a medium pile carpet. Other rooms, such as the room 42*d* (which can be a dining room) can include multiple surfaces where the rug 52 is located within the room 42*d*.

During cleaning or traveling operations, the robot 100 can use data collected from various sensors (such as optical sensors) and calculations (such as odometry and obstacle detection) to develop a map of the environment 40. Once the map is created, the user 60 can define rooms or zones (such as the rooms 42) within the map. The map can be presentable to the user 60 on a user interface, such as a mobile device, where the user 60 can direct or change cleaning preferences, for example.

Also, during operation, the robot 100 can detect surface types within each of the rooms 42, which can be stored in the robot or another device. The robot 100 can update the map (or data related thereto) such as to include or account for surface types of the floor surfaces 50*a*-50*e* of each of the respective rooms 42 of the environment. In some examples, the map can be updated to show the different surface types such as within each of the rooms 42.

In some examples, the user 60 can define a behavior control zone 54 using, for example, the methods and systems described herein. In response to the user 60 defining the behavior control zone 54, the robot 100 can move toward the behavior control zone 54 to confirm the selection. After confirmation, autonomous operation of the robot 100 can be initiated. In autonomous operation, the robot 100 can initiate a behavior in response to being in or near the behavior control zone 54. For example, the user 60 can define an area of the environment 40 that is prone to becoming dirty to be the behavior control zone 54. In response, the robot 100 can initiate a focused cleaning behavior in which the robot 100 performs a focused cleaning of a portion of the floor surface 50*d* in the behavior control zone 54.

Components of the Robot

Figure 2A:
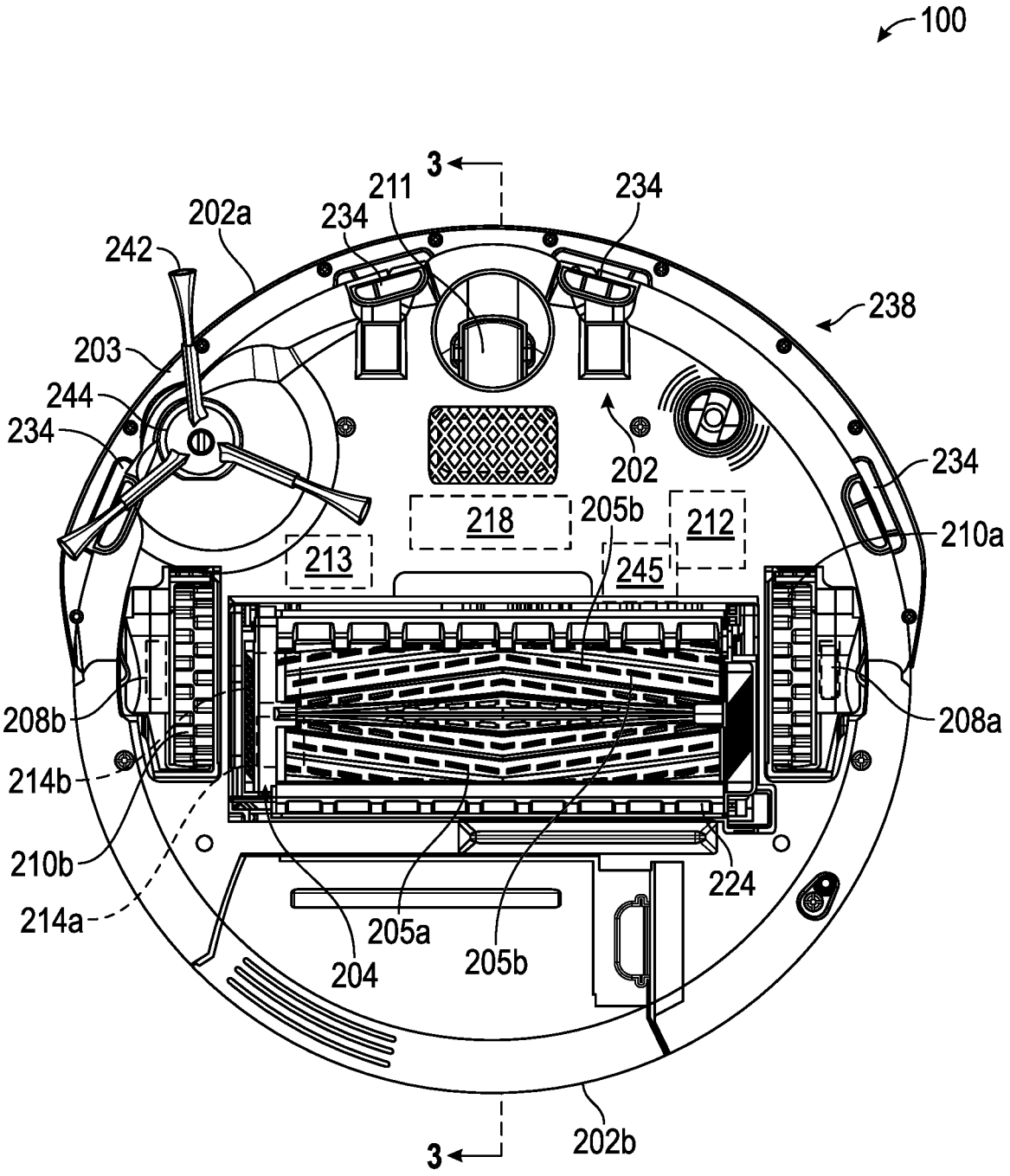
FIG. 2A illustrates a bottom view of a mobile cleaning robot.
Figure 2B:
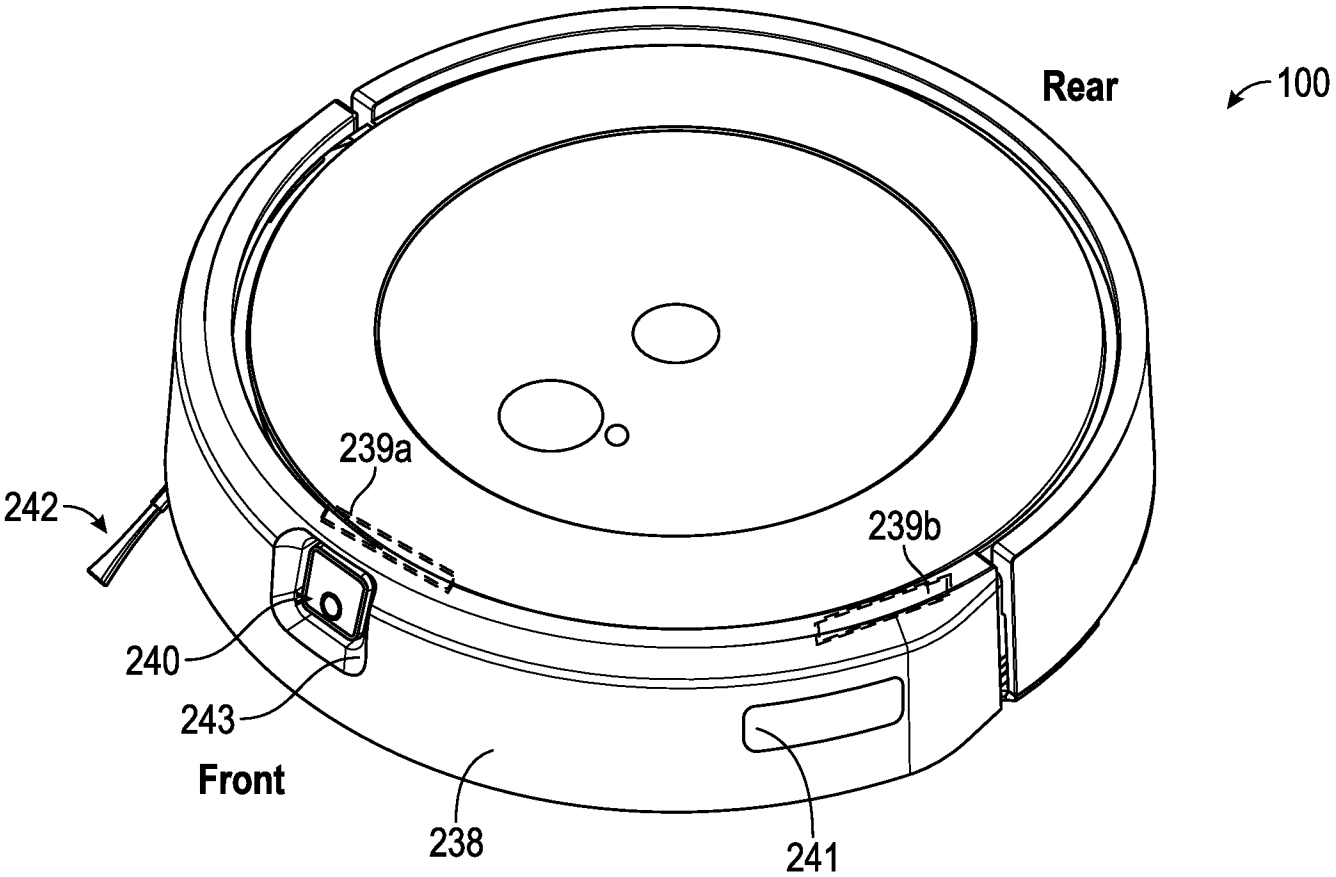
FIG. 2B illustrates an isometric view of a mobile cleaning robot.
Figure 3:
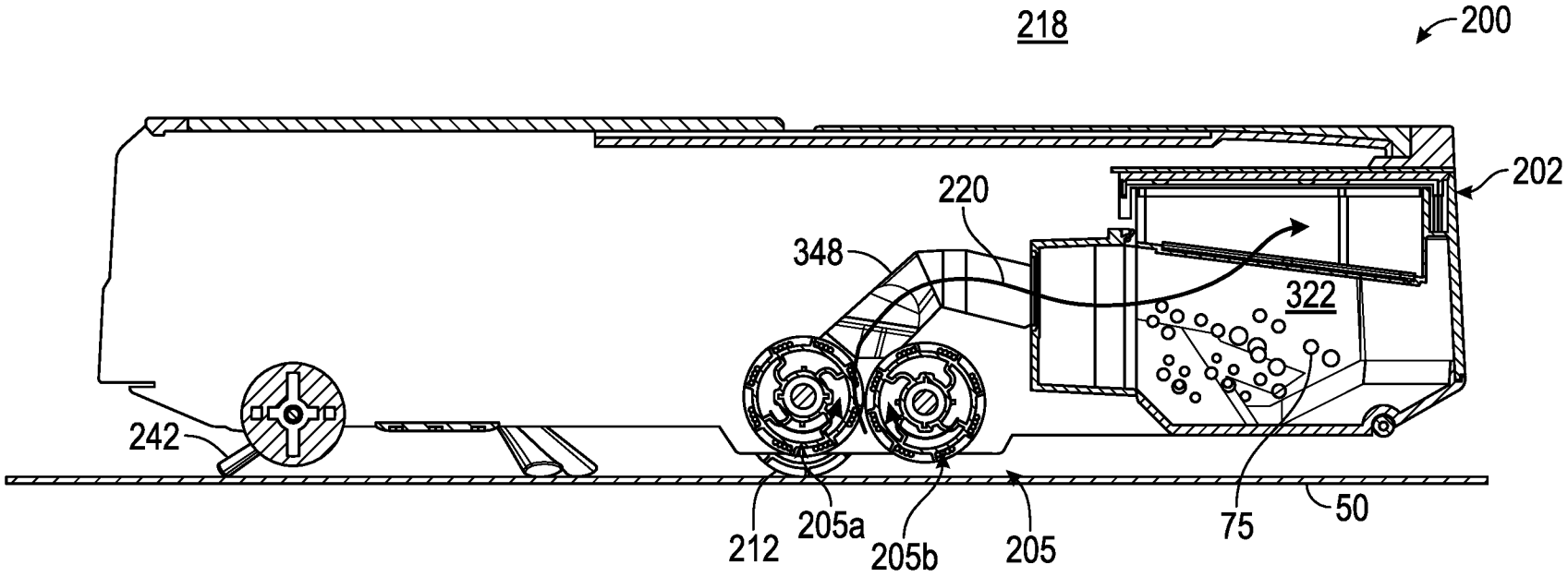
FIG. 3 illustrates a cross-section view across indicators 3-3 of FIG. 2A of a mobile cleaning robot.

FIG. 2A illustrates a bottom view of the mobile cleaning robot 100. FIG. 2B illustrates a bottom view of the mobile cleaning robot 100. FIG. 3 illustrates a cross-section view across indicators 3-3 of FIG. 2A of the mobile cleaning robot 100. FIG. 3 also shows orientation indicators Bottom, Top, Front, and Rear. FIGS. 2A-3 are discussed together below.

The cleaning robot 100 can be an autonomous cleaning robot that can autonomously traverse the floor surface 50 while ingesting the debris 75 from different parts of the floor surface 50. As shown in FIGS. 2A and 3, the robot 100 can include a body 202 movable across the floor surface 50. The body 202 can include multiple connected structures to which movable components of the cleaning robot 100 are mounted. The connected structures can include, for example, an outer housing to cover internal components of the cleaning robot 100, a chassis to which the drive wheels 210*a* and 210*b* and the cleaning rollers 205*a* and 205*b* (of a cleaning assembly 204) are mounted, and a bumper 238. A bumper 238 can be removably secured to the body 202 and can be movable relative to 202 while mounted thereto. In some examples, the bumper 238 form part of the body 202.

As shown in FIG. 2A, the body 202 includes a front portion 202*a* that has a substantially semicircular shape and a rear portion 202*b* that has a substantially semicircular shape. These portions can have other shapes in other examples. As shown in FIG. 2A, the robot 100 can include a drive system including actuators 208*a* and 208*b*, e.g., motors. The actuators 208*a* and 208*b* can be mounted in the body 202 and can be operably connected to the drive wheels 210*a* and 210*b*, which can be rotatably mounted to the body 202. The drive wheels 210*a* and 210*b* can support the body 202 above the floor surface 50. The actuators 208*a* and 208*b*, when driven, can rotate the drive wheels 210*a* and 210*b* to enable the robot 100 to autonomously move across the floor surface 50.

The controller (or processor) 212 can be located within the housing and can be a programmable controller, such as a single or multi-board computer, a direct digital controller (DDC), a programmable logic controller (PLC), or the like. In other examples the controller 212 can be any computing device, such as a handheld computer, for example, a smart phone, a tablet, a laptop, a desktop computer, or any other computing device including a processor, memory, and communication capabilities. The memory 213 can be one or more types of memory, such as volatile or non-volatile memory, read-only memory (ROM), random-access memory (RAM), magnetic disk storage media, optical storage media, flash-memory devices, and other storage devices and media. The memory 213 can be located within the body 200, connected to the controller 212 and accessible by the controller 212.

The controller 212 can operate the actuators 208*a* and 208*b* to autonomously navigate the robot 100 about the floor surface 50 during a cleaning operation. The actuators 208*a* and 208*b* can be operable to drive the robot 100 in a forward drive direction, in a backwards direction, and to turn the robot 100. The robot 100 can include a caster wheel 211 that supports the body 202 above the floor surface 50. The caster wheel 211 can support the rear portion 202*b* of the body 202 above the floor surface 50, and the drive wheels 210*a* and 210*b* support the front portion 202*a* of the body 202 above the floor surface 50.

As shown in FIG. 3, a vacuum assembly 218 can be located at least partially within the body 202 of the robot 100, e.g., in the rear portion 202*b* of the body 202. The controller 212 can operate the vacuum assembly 218 to generate an airflow that flows through the air gap near the cleaning rollers 205, through the body 202, and out of the body 202. The vacuum assembly 218 can include, for example, an impeller that generates the airflow when rotated. The airflow and the cleaning rollers 205, when rotated, can cooperate to ingest debris 75 into a suction duct 348 of the robot 100. The suction duct 348 can extend down to or near a bottom portion of the body 202 and can be at least partially defined by the cleaning assembly 204.

The suction duct 348 can be connected to the cleaning head 204 or cleaning assembly and can be connected to a cleaning bin 322. The cleaning bin 322 can be mounted in the body 202 and can contain the debris 75 ingested by the robot 100. A filter can be located in the body 202, which can separate the debris 75 from the airflow before the airflow 220 enters the vacuum assembly 218 and is exhausted out of the body 202. In this regard, the debris 75 can be captured in both the cleaning bin 322 and the filter before the airflow 220 is exhausted from the body 202.

The cleaning rollers 205*a* and 205*b* can operably connected to one or more actuators 214*a* and 214*b*, e.g., motors, respectively. The cleaning head 204 and the cleaning rollers 205*a* and 205*b* can positioned forward of the cleaning bin 322. The cleaning rollers 205*a* and 205*b* can be mounted to a housing 224 of the cleaning head 204 and mounted, e.g., indirectly or directly, to the body 202 of the robot 100. In particular, the cleaning rollers 205*a* and 205*b* can be mounted to an underside of the body 202 so that the cleaning rollers 205*a* and 205*b* engage debris 75 on the floor surface 50 during the cleaning operation when the underside faces the floor surface 50.

The housing 224 of the cleaning head 204 can be mounted to the body 202 of the robot 100. In this regard, the cleaning rollers 205*a* and 205*b* can also be mounted to the body 202 of the robot 100, e.g., indirectly mounted to the body 202 through the housing 224. Alternatively, or additionally, the cleaning head 204 can be a removable assembly of the robot 100 in which the housing 224 with the cleaning rollers 205*a* and 205*b* mounted therein is removably mounted to the body 202 of the robot 100. The housing 224 and the cleaning rollers 205*a* and 205*b* can be removable from the body 202 as a unit so that the cleaning head 205 is easily interchangeable with a replacement cleaning head.

A side brush 242 can be connected to an underside of the robot 100 and can be connected to a motor 244 operable to rotate the side brush 242 with respect to the body 202 of the robot 100. The side brush 242 can be configured to engage debris to move the debris toward the cleaning assembly 205 or away from edges of the environment 40. The motor 244 configured to drive the side brush 242 can be in communication with the controller 212. The brush 242 can be a side brush laterally offset from a center of the robot 100 such that the brush 242 can extend beyond an outer perimeter of the body 202 of the robot 100. Similarly, the brush 242 can also be forwardly offset of a center of the robot 100 such that the brush 242 also extends beyond the bumper 238.

The robot 100 can further include a sensor system with one or more electrical sensors. The sensor system can generate a signal indicative of a current location of the robot 100, and can generate signals indicative of locations of the robot 100 as the robot 100 travels along the floor surface 50.

For example, cliff sensors 234 (shown in FIG. 2A) can be located along a bottom portion of the body 200. Each of the cliff sensors 234 can be an optical sensor that can be configured to detect a presence or absence of an object below the optical sensor, such as the floor surface 50. The cliff sensors 234 can be connected to the controller 212.

The bump sensors 239*a* and 139*b* (the bump sensors 239) can be connected to the body 202 and engageable or configured to interact with the bumper 238. The bump sensors 239 can include break beam sensors, Hall Effect sensors, capacitive sensors, switches, or other sensors that can detect contact between the robot 100, i.e., the bumper 238, and objects in the environment 40. The bump sensors 239 can be in communication with the controller 212.

An image capture device 240 can be a camera connected to the body 202 and can extend at least partially through the bumper 238 of the robot 100, such as through an opening 243 of the bumper 238. The image capture device 240 can be a camera, such as a front-facing camera, configured to generate a signal based on imagery of the environment 40 of the robot 100 as the robot 100 moves about the floor surface 50. The image capture device 240 can transmit the signal to the controller 212 for use for navigation and cleaning routines.

Obstacle following sensors 241 (shown in FIG. 2B) can include an optical sensor facing outward from the bumper 238 that can be configured to detect the presence or the absence of an object adjacent to a side of the body 202. The obstacle following sensor 241 can emit an optical beam horizontally in a direction perpendicular (or nearly perpendicular) to the forward drive direction of the robot 100. The optical emitter can emit an optical beam outward from the robot 100, e.g., outward in a horizontal direction, and the optical detector detects a reflection of the optical beam that reflects off an object near the robot 100. The robot 100, e.g., using the controller 212, can determine a time of flight of the optical beam and thereby determine a distance between the optical detector and the object, and hence a distance between the robot 100 and the object.

The robot 100 can also optionally include one or more dirt sensors 245 connected to the body 202 and in communication with the controller 212. The dirt sensors 245 can be a microphone, piezoelectric sensor, optical sensor, or the like located in or near a flow path of debris, such as near an opening of the cleaning rollers 205 or in one or more ducts within the body 202. This can allow the dirt sensor(s) 245 to detect how much dirt is being ingested by the vacuum assembly 218 (e.g., via the extractor 204) at any time during a cleaning mission. Because the robot 100 can be aware of its location, the robot 100 can keep a log or record of which areas or rooms of the map are dirtier or where more dirt is collected. This information can be used in several ways, as discussed further below.

Operation of the Robot

In operation of some examples, the robot 100 can be propelled in a forward drive direction or a rearward drive direction. The robot 100 can also be propelled such that the robot 100 turns in place or turns while moving in the forward drive direction or the rearward drive direction.

When the controller 212 causes the robot 100 to perform a mission, the controller 212 can operate the motors 208 to drive the drive wheels 210 and propel the robot 100 along the floor surface 50. In addition, the controller 212 can operate the motors 214 to cause the rollers 205*a* and 205*b* to rotate, can operate the motor 244 to cause the brush 242 to rotate, and can operate the motor of the vacuum system 218 to generate airflow. The controller 212 can also execute software stored on the memory 213 to cause the robot 100 to perform various navigational and cleaning behaviors by operating the various motors or components of the robot 100.

The various sensors of the robot 100 can be used to help the robot navigate and clean within the environment 40. For example, the cliff sensors 234 can detect obstacles such as drop-offs and cliffs below portions of the robot 100 where the cliff sensors 234 are disposed. The cliff sensors 234 can transmit signals to the controller 212 so that the controller 212 can redirect the robot 100 based on signals from the cliff sensors 234.

In some examples, a bump sensor 239*a* can be used to detect movement of the bumper 238 along a fore-aft axis of the robot 100. A bump sensor 239*b* can also be used to detect movement of the bumper 238 along one or more sides of the robot 100. The bump sensors 239 can transmit signals to the controller 212 so that the controller 212 can redirect the robot 100 based on signals from the bump sensors 239.

In some examples, the obstacle following sensors 241 can detect detectable objects, including obstacles such as furniture, walls, persons, and other objects in the environment of the robot 100. In some implementations, the sensor system can include an obstacle following sensor along a side surface, and the obstacle following sensor can detect the presence or the absence an object adjacent to the side surface. The one or more obstacle following sensors 241 can also serve as obstacle detection sensors, similar to the proximity sensors described herein.

The robot 100 can also include sensors for tracking a distance travelled by the robot 100. For example, the sensor system can include encoders associated with the motors 208 for the drive wheels 210, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The image capture device 240 can be configured to generate a signal based on imagery of the environment 40 of the robot 100 as the robot 100 moves about the floor surface 50. The image capture device 240 can transmit such a signal to the controller 212. The image capture device 240 can capture images of wall surfaces of the environment so that features corresponding to objects on the wall surfaces can be used for localization.

The controller 212 can use data collected by the sensors of the sensor system to control navigational behaviors of the robot 100 during the mission. For example, the controller 212 can use the sensor data collected by obstacle detection sensors of the robot 100, (the cliff sensors 234, the bump sensors 239, and the image capture device 240) to enable the robot 100 to avoid obstacles within the environment of the robot 100 during the mission.

The sensor data can also be used by the controller 212 for simultaneous localization and mapping (SLAM) techniques in which the controller 212 extracts or interprets features of the environment represented by the sensor data and constructs a map of the floor surface 50 of the environment. The sensor data collected by the image capture device 240 can be used for techniques such as vision-based SLAM (VSLAM) in which the controller 212 extracts visual features corresponding to objects in the environment 40 and constructs the map using these visual features. As the controller 212 directs the robot 100 about the floor surface 50 during the mission, the controller 212 can use SLAM techniques to determine a location of the robot 100 within the map by detecting features represented in collected sensor data and comparing the features to previously stored features. The map formed from the sensor data can indicate locations of traversable and non-traversable space within the environment. For example, locations of obstacles can be indicated on the map as non-traversable space, and locations of open floor space can be indicated on the map as traversable space.

The sensor data collected by any of the sensors can be stored in the memory 213. In addition, other data generated for the SLAM techniques, including mapping data forming the map, can be stored in the memory 213. These data produced during the mission can include persistent data that are produced during the mission and that are usable during further missions. In addition to storing the software for causing the robot 100 to perform its behaviors, the memory 213 can store data resulting from processing of the sensor data for access by the controller 212. For example, the map can be a map that is usable and updateable by the controller 212 of the robot 100 from one mission to another mission to navigate the robot 100 about the floor surface 50.

The persistent data, including the persistent map, helps to enable the robot 100 to efficiently clean the floor surface 50. For example, the map enables the controller 212 to direct the robot 100 toward open floor space and to avoid non-traversable space. In addition, for subsequent missions, the controller 212 can use the map to optimize paths taken during the missions to help plan navigation of the robot 100 through the environment 40.

Network Examples

Figure 4:
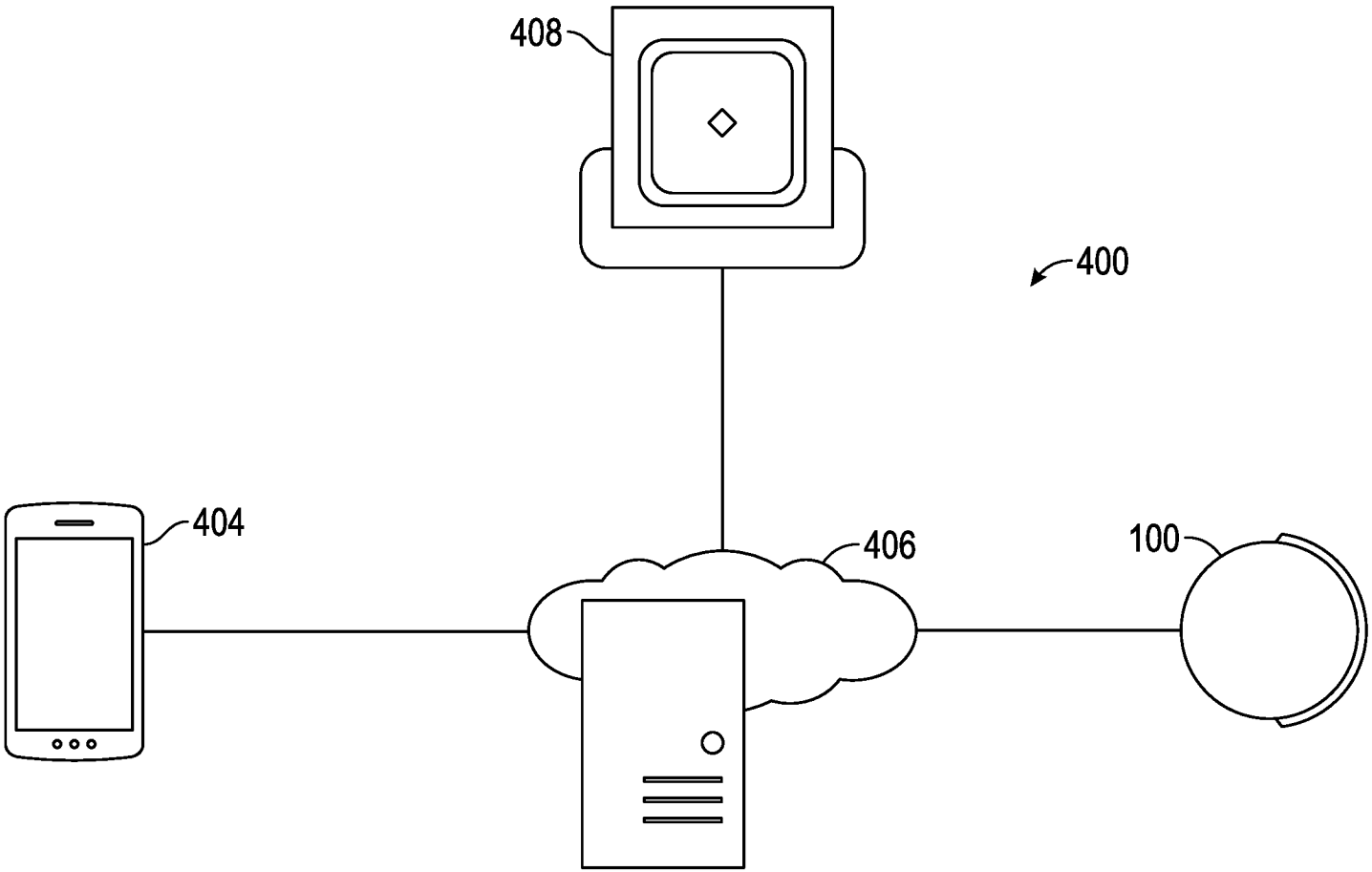
FIG. 4 illustrates a diagram illustrating an example of a communication network in which a mobile cleaning robot operates and data transmission in the network.

FIG. 4 is a diagram illustrating by way of example and not limitation a communication network 400 that enables networking between the mobile robot 100 and one or more other devices, such as a mobile device 404, a cloud computing system 406, or another autonomous robot 408 separate from the mobile robot 100. Using the communication network 410, the robot 100, the mobile device 404, the robot 408, and the cloud computing system 406 can communicate with one another to transmit and receive data from one another. In some examples, the robot 100, the robot 408, or both the robot 100 and the robot 408 communicate with the mobile device 404 through the cloud computing system 406. Alternatively, or additionally, the robot 100, the robot 408, or both the robot 100 and the robot 408 communicate directly with the mobile device 404. Various types and combinations of wireless networks (e.g., Bluetooth, radio frequency, optical based, etc.) and network architectures (e.g., mesh networks) can be employed by the communication network 410.

In some examples, the mobile device 404 can be a remote device that can be linked to the cloud computing system 406 and can enable a user to provide inputs. The mobile device 404 can include user input elements such as, for example, one or more of a touchscreen display, buttons, a microphone, a mouse, a keyboard, or other devices that respond to inputs provided by the user. The mobile device 404 can also include immersive media (e.g., virtual reality) with which the user can interact to provide input. The mobile device 404, in these examples, can be a virtual reality headset or a head-mounted display.

The user can provide inputs corresponding to commands for the mobile robot 100. In such cases, the mobile device 404 can transmit a signal to the cloud computing system 406 to cause the cloud computing system 406 to transmit a command signal to the mobile robot 100. In some implementations, the mobile device 404 can present augmented reality images. In some implementations, the mobile device 404 can be a smart phone, a laptop computer, a tablet computing device, or other mobile device.

According to some examples discussed herein, the mobile device 404 can include a user interface configured to display a map of the robot environment. A robot path, such as that identified by a coverage planner, can also be displayed on the map. The interface can receive a user instruction to modify the environment map, such as by adding, removing, or otherwise modifying a keep-out zone in the environment; adding, removing, or otherwise modifying a focused cleaning zone in the environment (such as an area that requires repeated cleaning); restricting a robot traversal direction or traversal pattern in a portion of the environment; or adding or changing a cleaning rank, among others.

In some examples, the communication network 410 can include additional nodes. For example, nodes of the communication network 410 can include additional robots. Also, nodes of the communication network 410 can include network-connected devices that can generate information about the environment 40. Such a network-connected device can include one or more sensors, such as an acoustic sensor, an image capture system, or other sensor generating signals, to detect characteristics of the environment 40 from which features can be extracted. Network-connected devices can also include home cameras, smart sensors, or the like.

In the communication network 410, the wireless links can utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel, satellite band, or the like. In some examples, wireless links can include any cellular network standards used to communicate among mobile devices, including, but not limited to, standards that qualify as 1G, 2G, 3G, 4G, 5G, 6G, or the like. The network standards, if utilized, qualify as, for example, one or more generations of mobile telecommunication standards by fulfilling a specification or standards such as the specifications maintained by International Telecommunication Union. For example, the 4G standards can correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards can use various channel access methods, e.g., FDMA, TDMA, CDMA, or SDMA.

Suction Guide Examples

Figure 5:
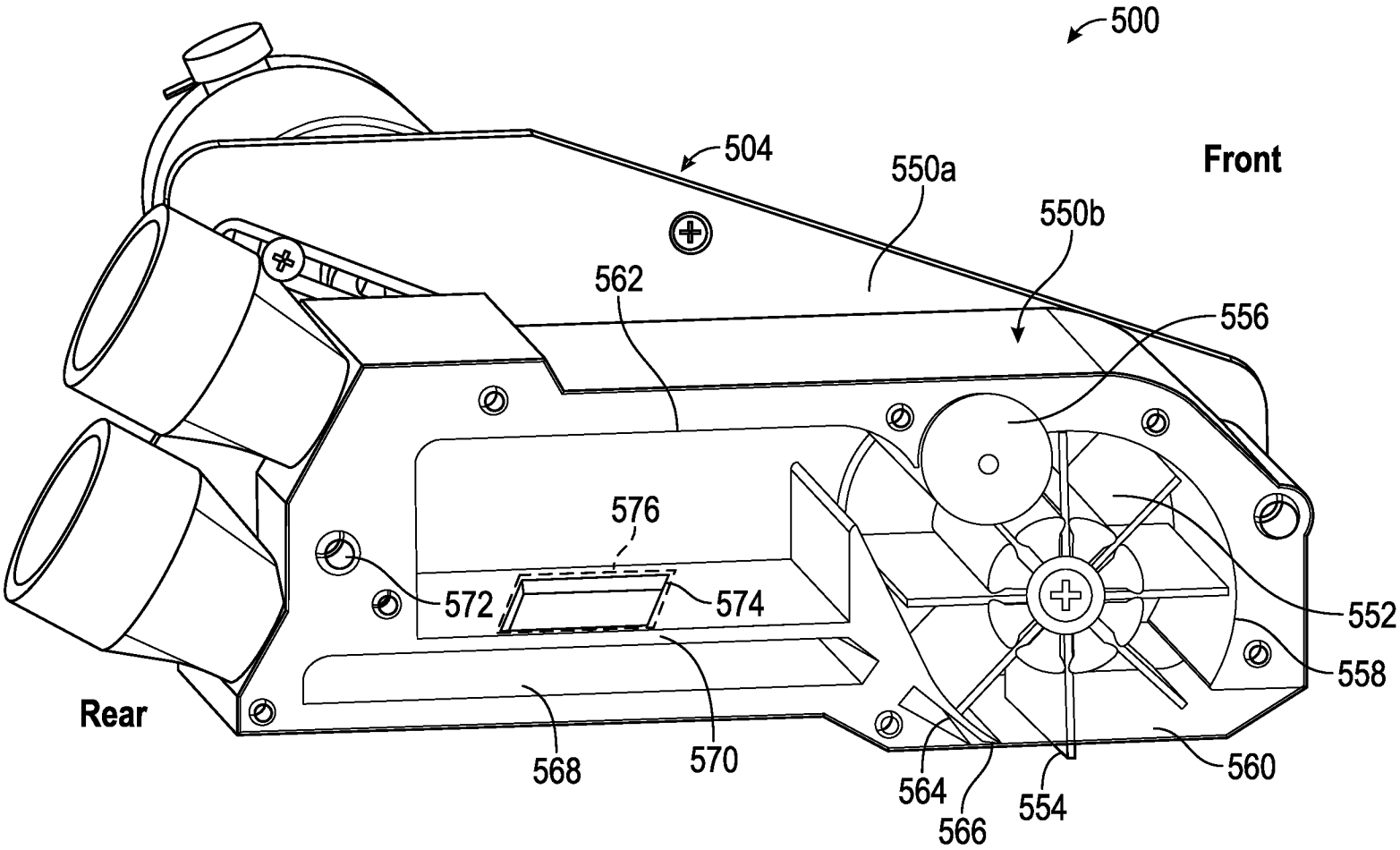
FIG. 5 illustrates a side isometric view of a portion of a mobile cleaning robot.

FIG. 5 illustrates a side isometric view of a cleaning assembly 504 of a mobile cleaning robot 500. The cleaning assembly 504 can be similar to the cleaning assembly 204 discussed above. The cleaning assembly 504 can include features for adjusting one or more suction guides of the mobile cleaning robot 500. Any of the cleaning assemblies of any robot discussed above or below can include the features of the cleaning assembly 504 or the mobile cleaning robot 500. FIG. 5 also shows orientation indicators Front and Rear.

The cleaning assembly 504 can include a support or casing 550 including a first portion 550*a* and a second portion 550*b*. The casing 550 can be sized and shaped to support one or more cleaning rollers 552 therein. The one or more cleaning rollers 552 can be similar to the cleaning rollers 205 discussed above. The one or more cleaning rollers 552 can optionally include bristles or fletches 554. A bristle can be a fiber or length of material such as of a brush. A fletch can be vane or elongate member made of a flexible material, such as rubber or silicone. The cleaning assembly 504 can also include a roller 556, which can optionally be a passive roller engageable with the bristles 554 of the roller 552.

The support 550 can define a roller housing 558 configured to at least partially surround and optionally engage the one or more cleaning rollers 552. The roller housing 558 can be open toward a bottom to define a first debris port 560, such as to allow the bristles 554 to engage a floor surface of an environment and to allow debris to be collected into a first debris chamber 562, which can be connected to a vacuum assembly (e.g., the vacuum assembly 218) of the mobile cleaning robot 500. A rear portion of the roller housing 558 can be connected to the first debris chamber 562.

The casing 550 can also define or include a second debris port 564 open to a bottom portion of the cleaning assembly 504 of the mobile cleaning robot 500. The second debris port 564 can be in a parallel flow arrangement with respect to the first debris port 560. Optionally, the second debris port 564 can be located rearward of the first debris port 560 and can be separated by a lip 566 of the roller housing 558. The second debris port 564 can be configured to extract debris form the environment. Optionally, the second debris port 564 can form a relatively small opening, which can create or produce a relatively higher suction (lower pressure) such as to improve extraction relatively small or fine debris from the environment. Because the first debris port 560 is relatively large and includes the one or more cleaning rollers 552, the first debris port 560 can be more effective at capturing or ingesting large debris.

A rear portion or upper portion of the second debris port 564 can be connected to a second debris chamber 568, which can be separated from the first debris chamber by a wall 570. A rear portion of the first debris chamber 562 can connect to the vacuum system as can a rear portion of the second debris chamber 568. Optionally, the second portion 550*b* can include a valve 572 movable between an open position and a closed position to selectably direct flow through one or more of the first debris port 560 and the second debris port 564, such as to open and close at least one of the first debris port 560 and the second debris port 564.

The wall 570, which can be a divider or a dividing wall, can optionally include an opening 574 or passage between the first debris chamber 562 and the second debris chamber 568. The second portion 550*b* can further include a door 576 configured to move between an open position and a closed position, where the opening 574 is open to connect the first debris chamber 562 to the second debris chamber 568 when the door is in the open position. When the door 576 is in the closed position, the opening 574 can be closed or sealed such that the first debris chamber 562 is separated or isolated from the second debris chamber 568. Optionally, the door 576 can be configured to move from the closed position to the open position when the door 576 is exposed to an evacuation suction pressure (such as from an evacuation station) that is higher than a normal operating suction pressure (such as from a vacuum system of the mobile cleaning robot 500).

In operation of some examples, the cleaning assembly 504 can be operated, such as by a controller (e.g., the controller 212) in two or more modes. In one mode, the controller can operate the valve 572 to send flow (e.g., from the vacuum assembly 218) through the first debris chamber 562 and the first debris port 560 to capture debris from the environment, which can be assisted by the one or more cleaning rollers 552 and the roller 556. In another mode, the controller can operate the valve 572 to send flow (e.g., from the vacuum assembly 218) through the second debris chamber 568 and second debris port 564 to capture debris from the environment. Optionally, the controller can operate the valve 572 to send flow through both the first debris port 560 and the second debris port 564.

Optionally, the controller can operate the valve 572 to control flow through the first debris port 560 or the second debris port 564 based on a type of debris detected in the environment, such as using an image capture device (e.g., the image capture device 240). For example, when large debris is detected, the controller can operate the valve 572 to send flow through the first debris port 560. When fine debris is detected, the controller can operate the valve 572 to send flow through the second debris port 564.

Optionally, the roller 556 can help to operate the roller 552 into as a pump (such that the roller 552 supplements airflow through the system). The 556 roller can squeeze air out of the 552 roller such that this air is then compressed and forced up the first debris port 560 and into the first debris chamber 562. Optionally, exhaust (or regeneration (regen) air) can be discharged through the second debris port 564, as discussed in further embodiments below.

Figure 6A:
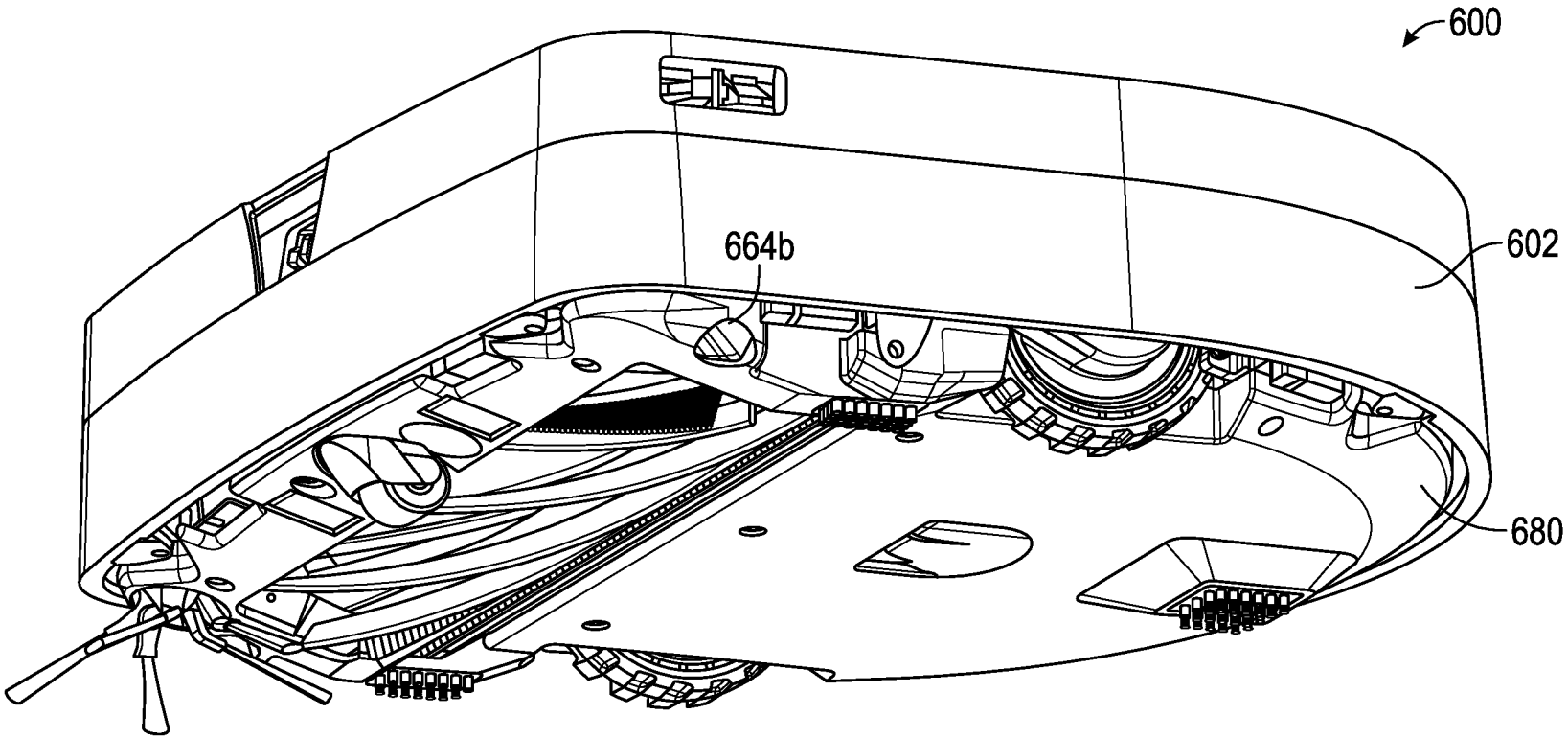
FIG. 6A illustrates a bottom perspective view of a mobile cleaning robot.
Figure 6B:
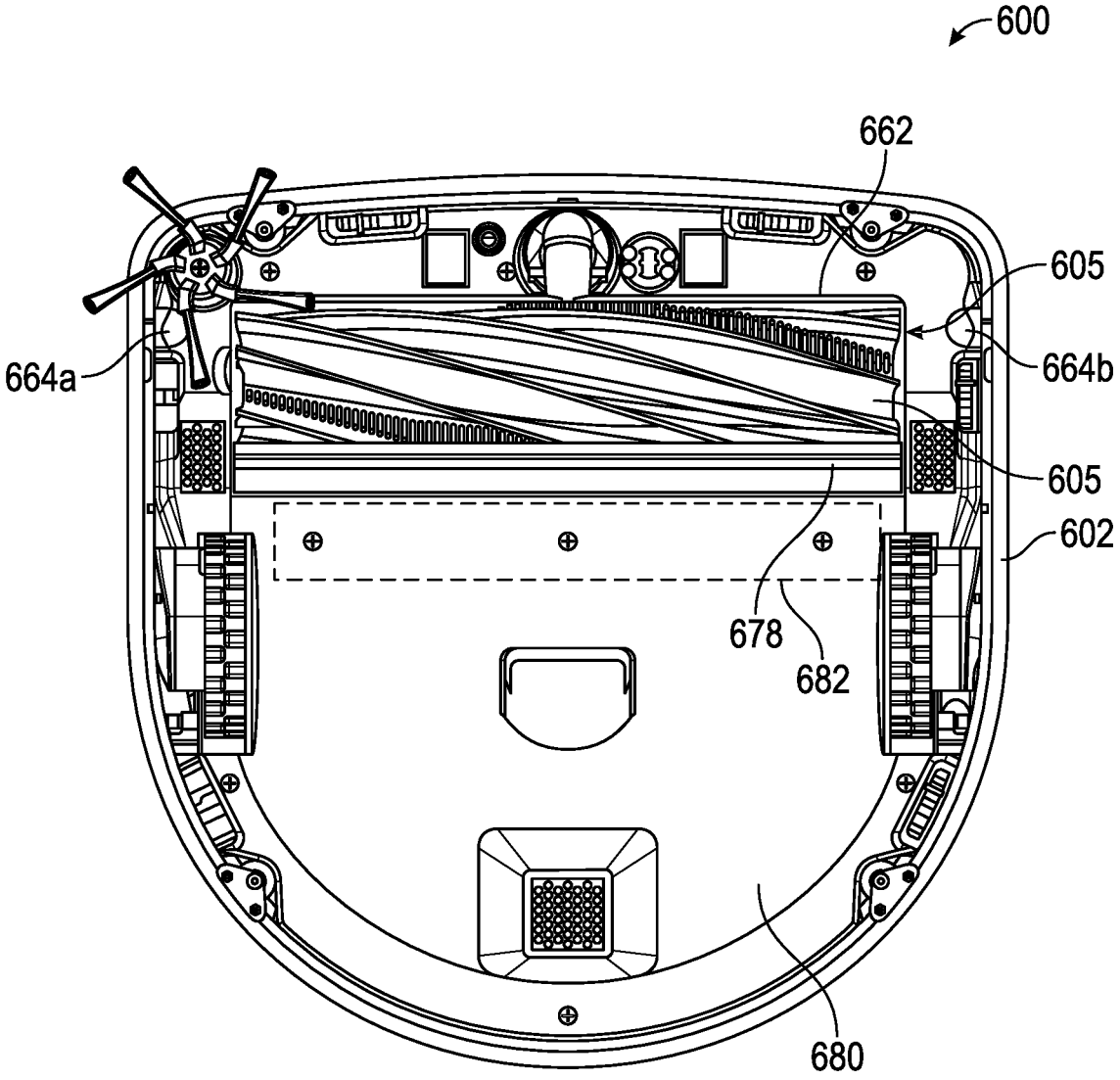
FIG. 6B illustrates a bottom view of a mobile cleaning robot.

FIG. 6A illustrates a bottom perspective view of a mobile cleaning robot 600. FIG. 6B illustrates a bottom view of the mobile cleaning robot 600. FIGS. 6A and 6B are discussed together below. The mobile cleaning robot 600 can be similar to the robots discussed above; the mobile cleaning robot 600 can include laterally outward debris ports that can be optionally used to collect debris along edges, for example. Any of the robots discussed above or below can include the features of the mobile cleaning robot 600.

More specifically, the mobile cleaning robot 600 can include a body 602, which can be similar to the body 202 discussed above, but can have a different shape, such as a relatively flat front bumper. The mobile cleaning robot 600 can support a cleaning assembly 604, which can be similar to the cleaning assemblies discussed above, in that the cleaning assembly 604 can define an opening that can be a first debris port 662.

The cleaning assembly 604 can include a roller 605 therein, configured to rotate to help ingest debris. The cleaning assembly 604 can optionally include a dustpan 678 engageable with the roller 605 to help extract debris, as discussed in U.S. patent application Ser. No. 17/388,302, to Amaral et. al., filed Jul. 31, 2021, which is incorporated by reference herein in its entirety.

The body 602 can include a bottom portion 680, which can be, for example, a bottom skid or bottom cover plate. The bottom portion 680 can at least partially define the first debris port 662 and can at least partially define second debris ports 664*a* and 664*b* (collectively referred to as second debris ports 664). The second debris ports 664 can be located at lateral sides of the robot (e.g., left and right sides), such as laterally outward of the roller 605. The second debris ports 664 can be located in line with the first debris port 662 or can be located forward or rear of the first debris port 662. The second debris ports 664 can be located with respect to the body 602 such that the second debris ports 664 are near lateral edges or sides of the mobile cleaning robot 600. This can allow the second debris ports 664 to pick up debris (optionally fine debris) along edges within an environment, such as along walls or baseboards.

Optionally, one or more of the second debris ports 664 can be exhaust ports, configured to exhaust air from a vacuum system (e.g., the vacuum assembly 218). The robot mobile cleaning robot 600 can use the exhaust ports to move trapped debris that cannot be reached, for example, by the first debris port 662 or a side brush. Any of the debris ports discussed herein can be configured to exhaust air therethrough.

The body 602 can also include a valve 682 that can be located within the body 602. The valve 682 can be in communication with a controller (e.g., the controller 212) and can be operated by the controller to control flow of air from its vacuum system (e.g., the vacuum assembly 218) to the first debris port 662 or the second debris ports 664. Optionally, when air is directed through the second debris ports 664, the roller 605 can continue to rotate to extract debris through the first debris port 662 such as by using mechanical force of the roller 605 and the dustpan 678.

Figure 7:
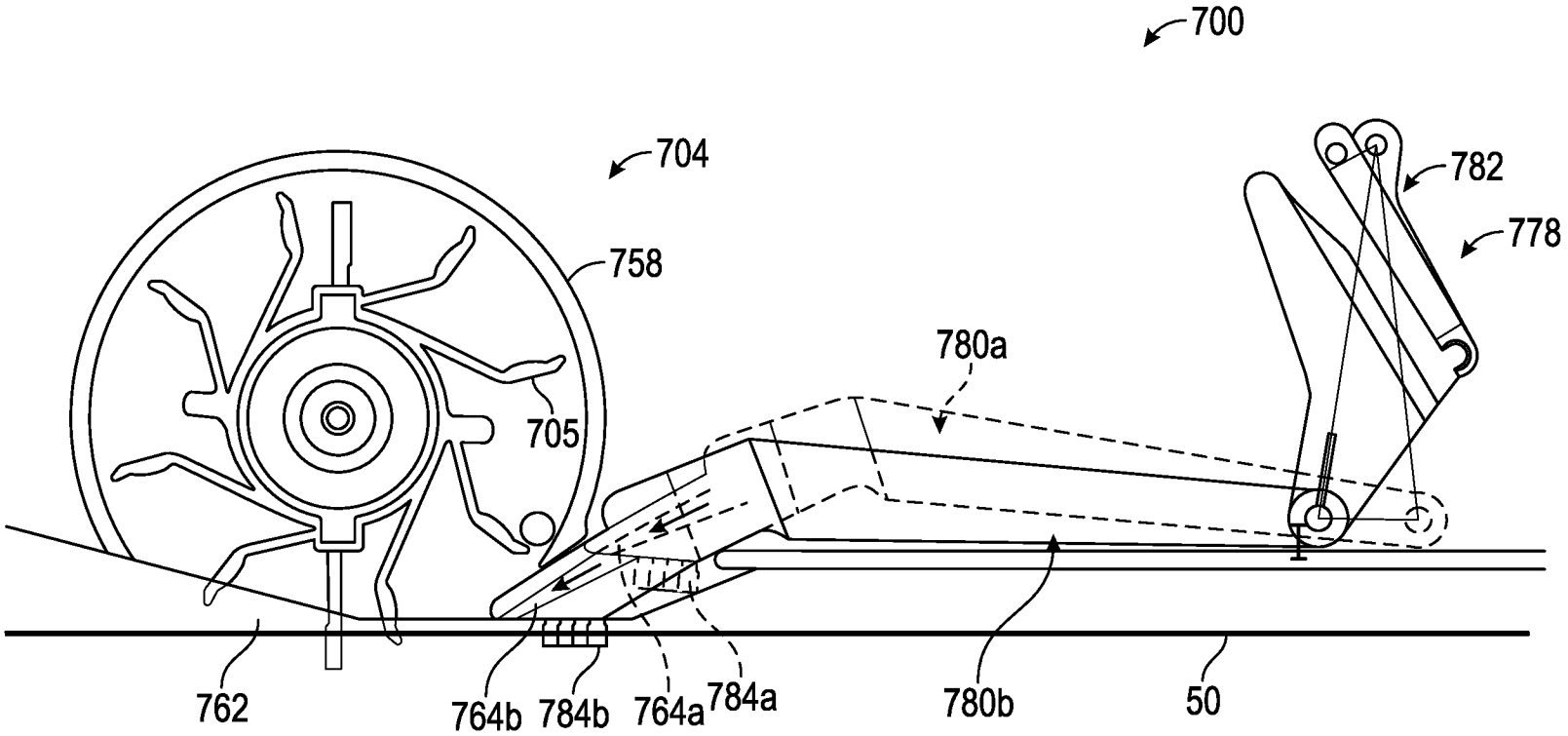
FIG. 7 illustrates a side cross-sectional view of a portion of a mobile cleaning robot.

FIG. 7 illustrates a side cross-sectional view of a portion of a mobile cleaning robot 700. The mobile cleaning robot 700 can be similar to the robots discussed above; the mobile cleaning robot 700 can include a retractable arm including one or more debris ports. Any of the robots discussed above or below can include the features of the mobile cleaning robot 700.

The mobile cleaning robot 700 can include a cleaning assembly 704 including a roller 705 located at least partially within a housing 758 of the cleaning assembly 704. The housing 758 can be at least partially open such as to form a first debris port 762 configured to be oriented toward a floor surface 50 of the environment. The roller 705 can be rotatable within and with respect to the housing 758. The housing 758 can be connected to a vacuum system (e.g., the vacuum assembly 218) of the mobile cleaning robot 700. As the roller 705 rotates within the housing 758, the roller 705 can engage and extract debris from the floor surface 50 through the first debris port 762 into a debris bin (e.g., the cleaning bin 322).

The mobile cleaning robot 700 can also include an arm assembly 778 including an arm 780 and an actuator assembly 782. The actuator assembly 782 can be operable (such as via a controller (e.g., the controller 212)) to move the arm 780 relative to a body of the mobile cleaning robot 700 between a retracted position (indicated by the arm 780*a*) and an extended position (indicated by the arm 780*b*). Optionally, the actuator assembly 782 can be a passive assembly, such as one including one or more biasing elements (e.g., springs) to bias the arm 780 and the second debris port 764 toward the roller 705, such as to allow rearward movement of the arm 780 (such as to retract the arm 780) when the arm 780 engages obstacles such as rugs or thresholds.

The arm 780 can include a second debris port 764 and a skid 784. The skid 784 can include bristles or can be a low friction pad (e.g., nylon or Polytetrafluoroethylene) and can be configured to engage the floor surface 50 to support the arm 780. For example, the skid 784 can be above the floor surface 50 when the arm 780 is in the retracted position (as shown by the skid 784*a*), and the skid 784 can be engaged with the floor surface 50 when the arm 780 is in the extended position (as shown by the skid 784*b*).

The second debris port 764 can be one or more bores or ports extending at least partially through the arm 780. The second debris port 764 can be connected to a vacuum system of the mobile cleaning robot 700 (e.g., the vacuum assembly 218). When the arm 780*b* is in the extended position, the second debris port 764*b* can be located close to the floor surface 50 such that the second debris port 764 terminates closer to the cleaning assembly (e.g., the roller 705) when the arm 780 is in the extended position than when the arm 780 is in the retracted position. This can help the second debris port 764 to extract debris from the floor surface 50. Because the second debris port 764 is relatively small (as compared to the first debris port 762), the second debris port 764 can be more efficient at collecting small or fine debris than the first debris port 762.

Figure 8:
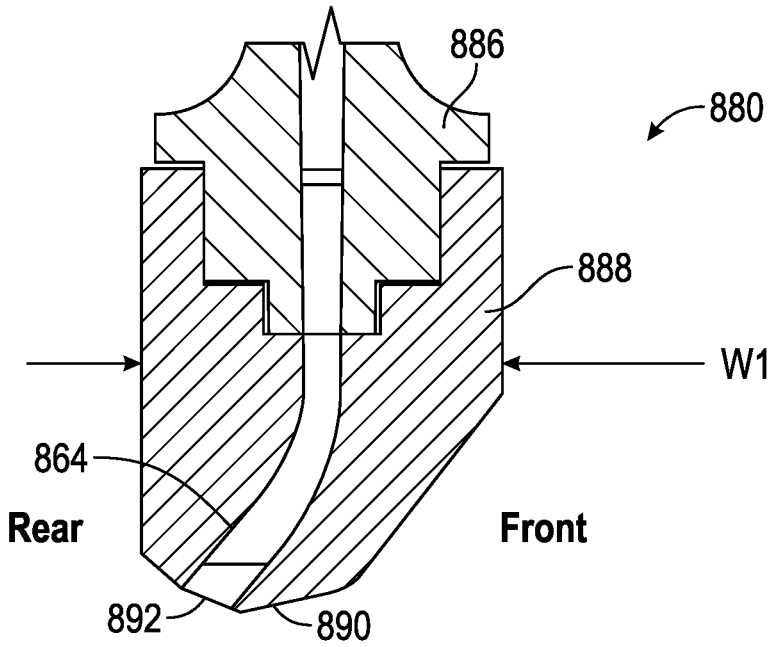
FIG. 8 illustrates a cross-sectional view of a portion of a mobile cleaning robot.
Figure 9:
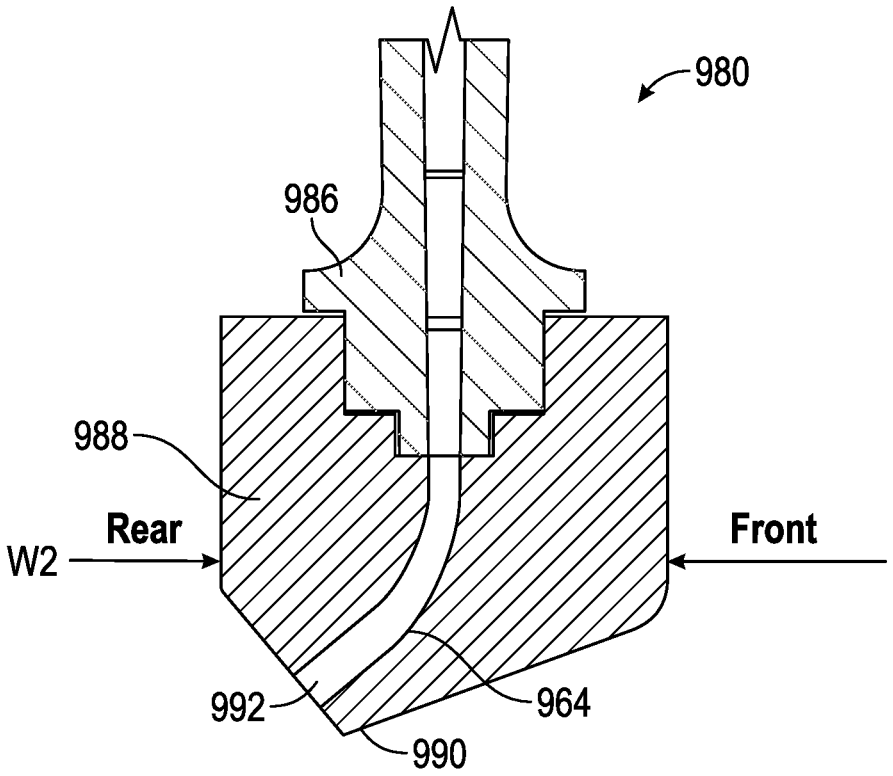
FIG. 9 illustrates a cross-sectional view of a portion of a mobile cleaning robot.

FIG. 8 illustrates a cross-sectional view of an arm 880 of a mobile cleaning robot. FIG. 9 illustrates a cross-sectional view of an arm 980 of a mobile cleaning robot. FIGS. 8 and 9 also show orientation indicators Front and Rear. FIGS. 8 and 9 are discussed together below.

The arms 880 and 980 can be similar to the arm 780 discussed above; the arms 880 and 980 can include a fletch or flexible member for agitating or moving carpet fibers to improve debris extraction. Optionally, the fletch can be rigid. Any of the robots discussed above or below can include the features of the arms 880 or 980, such that the arms can work together with a main or first debris port. Optionally, the arms can define only debris port (or there can be a plurality of arms defining a plurality of debris ports).

The arm 880 can include a shaft 886 and a fletch 888 connected to the shaft 886, where the shaft 886 and the fletch 888 can together define a second debris port 864 extending at least partially therethrough. The fletch 888 can include a tip 890 engageable with carpet fibers, as discussed in further detail below. The second debris port 864 can extend through the fletch 888 and can be curved or swept from front to rear as the second debris port 864 extends from the shaft 886 to an opening 892 near the tip 890 of the fletch 888.

The arm 980 can be similarly configured to the arm 880, such that the arm 980 can include a shaft 986 and a fletch 988 defining a second debris port 964. The fletch 988 can include a tip 990 and can include an opening 992 of the second debris port near the tip 990.

The fletch 888 can define a width W1 (e.g., front to rear) that can be relatively smaller than a width W2 of the fletch 988 of the arm 980. The varying widths can accommodate different shapes of the debris port. For example, the second debris port 964 can be swept further rearward than the second debris port 864. The shape of the second debris port

864 can make the arm 880 better at extracting debris from between fibers of a carpet having a lower pile. Conversely, the larger width W2 and its larger curvature of the second debris port 964 can make the arm 980 better at extracting debris from between fibers of a carpet having a higher pile. The larger width can also allow the fletch 988 to float or pass over higher pile carpeting while the smaller width can help the fletch 888 to penetrate lower pile carpeting. The width of either arm can be optimized for extraction of debris of any fiber length or pile height.

Figure 10:
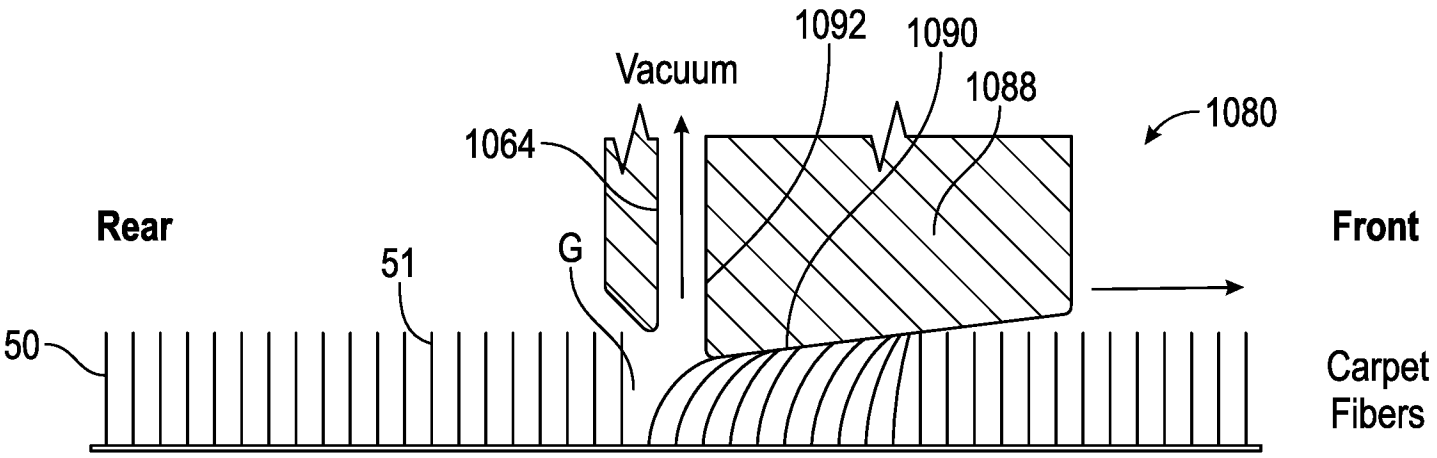
FIG. 10 illustrates a cross-sectional view of a portion of a mobile cleaning robot in an environment.

FIG. 10 illustrates a cross-sectional view of an arm 1080 of a mobile cleaning robot engaging a surface 50 of an environment. The surface can include carpet fibers 51. The arm 1080 can be similar to either of the arm 880 or the arm 980; FIG. 1080 shows how such an arm can operate.

As the robot (e.g., any robot discussed herein) traverses the floor surface 50 moving forward, a fletch 1088 can engage the fibers 51. A tip 1090 of the fletch 1088 can move the fibers 51 forward creating a gap G between the fibers 51. Due to the location of an opening 1092 near the tip 1090, when the fibers 51 are urged forward by the tip 1090, the opening 1092 can align with the gap G to allow for extraction of debris through the opening 1092 and into a second suction port 1064 of the robot. In this way, the arm 1080 (or the arms 880 or 980) can be used to extract debris embedded between fibers 51 of the floor surface 50.

Optionally, any of the fletches of the arms 880, 980, or 1080 can be connected to a roller, as discussed below with reference to FIG. 16.

Figure 11:
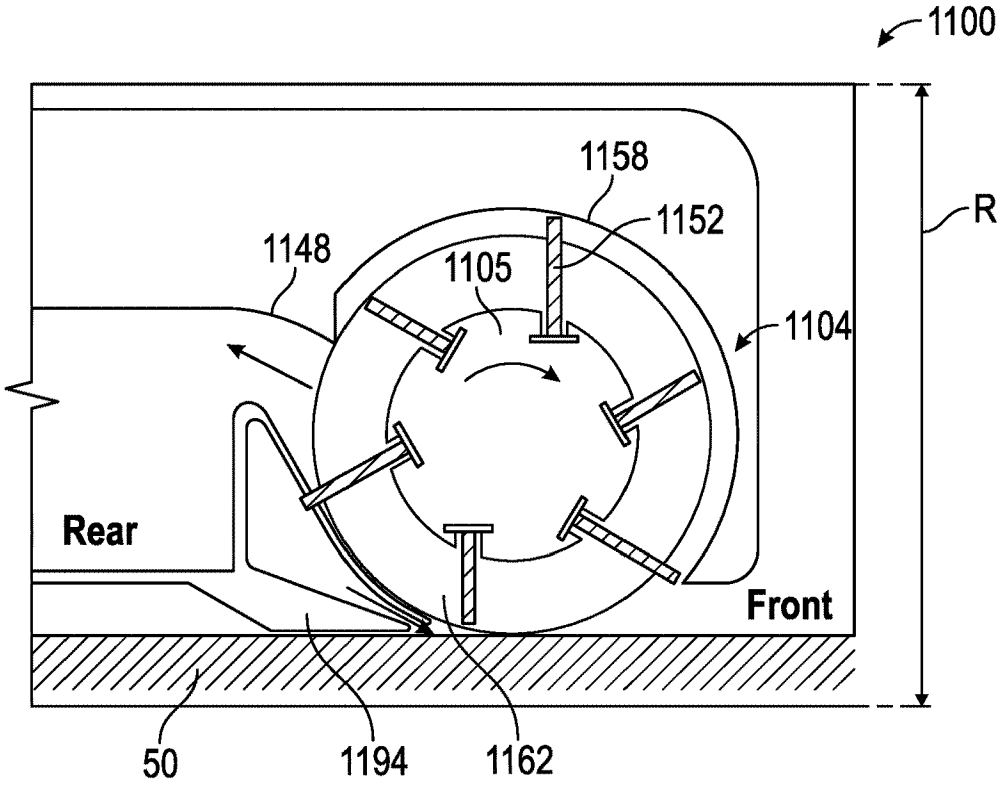
FIG. 11 illustrates a cross-sectional view of a portion of a mobile cleaning robot in an environment.

FIG. 11 illustrates a cross-sectional view of a cleaning assembly 1104 of a mobile cleaning robot 1100 in an environment. The cleaning assembly 1104 can be similar to the cleaning assemblies discussed above; the cleaning assembly 1104 can include a regeneration air discharge. Any of the robots discussed above or below can include the features of the mobile cleaning robot 1100.

More specifically, the cleaning assembly 1104 can include a roller 1105 within a roller housing 1158. The roller 1105 can include radially extending fletches 1152 engageable with the floor surface 50. Similar to other embodiments discussed above, the cleaning assembly 1104 can include a first debris port 1162 connected to a suction duct 1148 for extraction of debris from the floor surface 50.

The cleaning assembly 1104 can also include an exhaust port 1194 located near, or at, a rear portion of the first debris port 1162. The exhaust port 1194 can be connected to a vacuum system of the mobile cleaning robot 1100 (e.g., the vacuum assembly 218) and can be configured to receive exhaust air therefrom. The exhaust port 1194 can be configured to discharge the exhaust air from the vacuum system to a rear portion of the first debris port 1162. The exhaust air can be discharged at a velocity configured to help direct debris forward toward the first debris port 1162, such as debris that has moved, or may move, past the first debris port 1162, helping to improve overall cleaning efficiency of the cleaning assembly 1104 and the mobile cleaning robot 1100.

Figure 12:
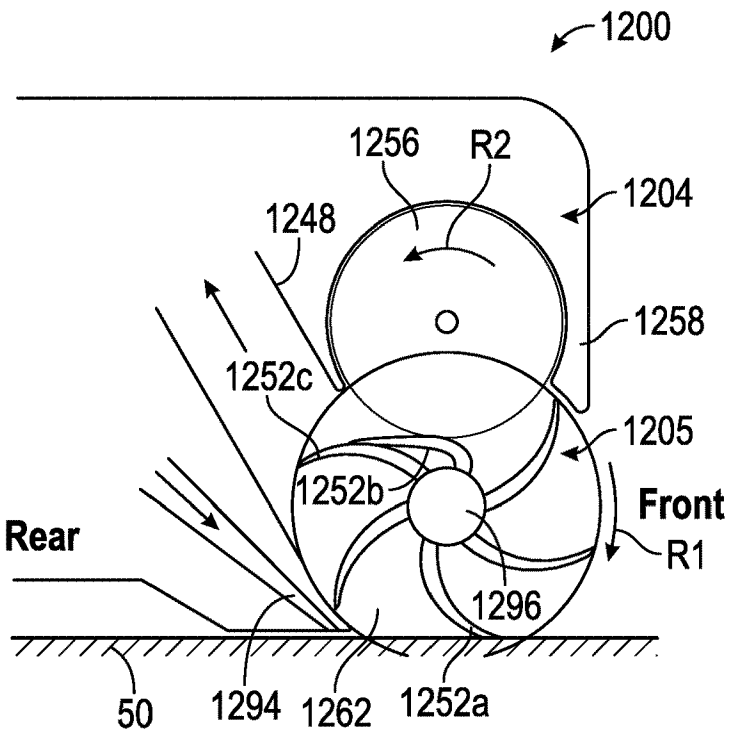
FIG. 12 illustrates a cross-sectional view of a portion of a mobile cleaning robot in an environment.

FIG. 12 illustrates a cross-sectional view of a cleaning assembly 1204 of a mobile cleaning robot 1200 in an environment. The cleaning assembly 1204 can be similar to the cleaning assemblies discussed above; the cleaning assembly 1204 can include a regeneration air discharge and a roller configured to generate suction. Any of the robots discussed above or below can include the features of the mobile cleaning robot 1200.

More specifically, the cleaning assembly 1204 can include a roller 1205 located at least partially within a roller housing 1258 and rotatable therein. The cleaning assembly 1204 can also include a roller 1256, which can be connected to the roller housing 1258 and rotatable with respect thereto. For example, the roller 1205 can rotate in a first direction R1 and the roller 1256 can rotate in a second direction R2, such that the roller 1256 can rotate in a direction opposite the roller 1205.

FIG. 12 also shows an exhaust port 1294 that can be configured to discharge are toward a rear portion of the roller 1205 and a debris port 1262, similar to the exhaust port 1194 discussed above. FIG. 12 further shows that the roller 1205 can include a plurality of fletches 1252 (e.g., 1252*a* and 1252*b*). The fletches 1252 can extend radially outward from a core 1296 of the roller 1205. Optionally, the fletches 1252 can be configured to flex relative to the core 1296. For example, as the fletch 1252*b* passes the roller 1256, the fletch 1252*b* can flex or bend, causing air or debris between the fletch 1252*b* and the fletch 1252*c* to be extracted into a suction duct 1248. As the 1252*b* extends as it passes the roller 1256, the fletch 1252*b* can help to create a vacuum at the inlet of the debris port 1262 to help draw in additional debris, helping to improve cleaning efficiency of the roller 1205.

Figure 13:
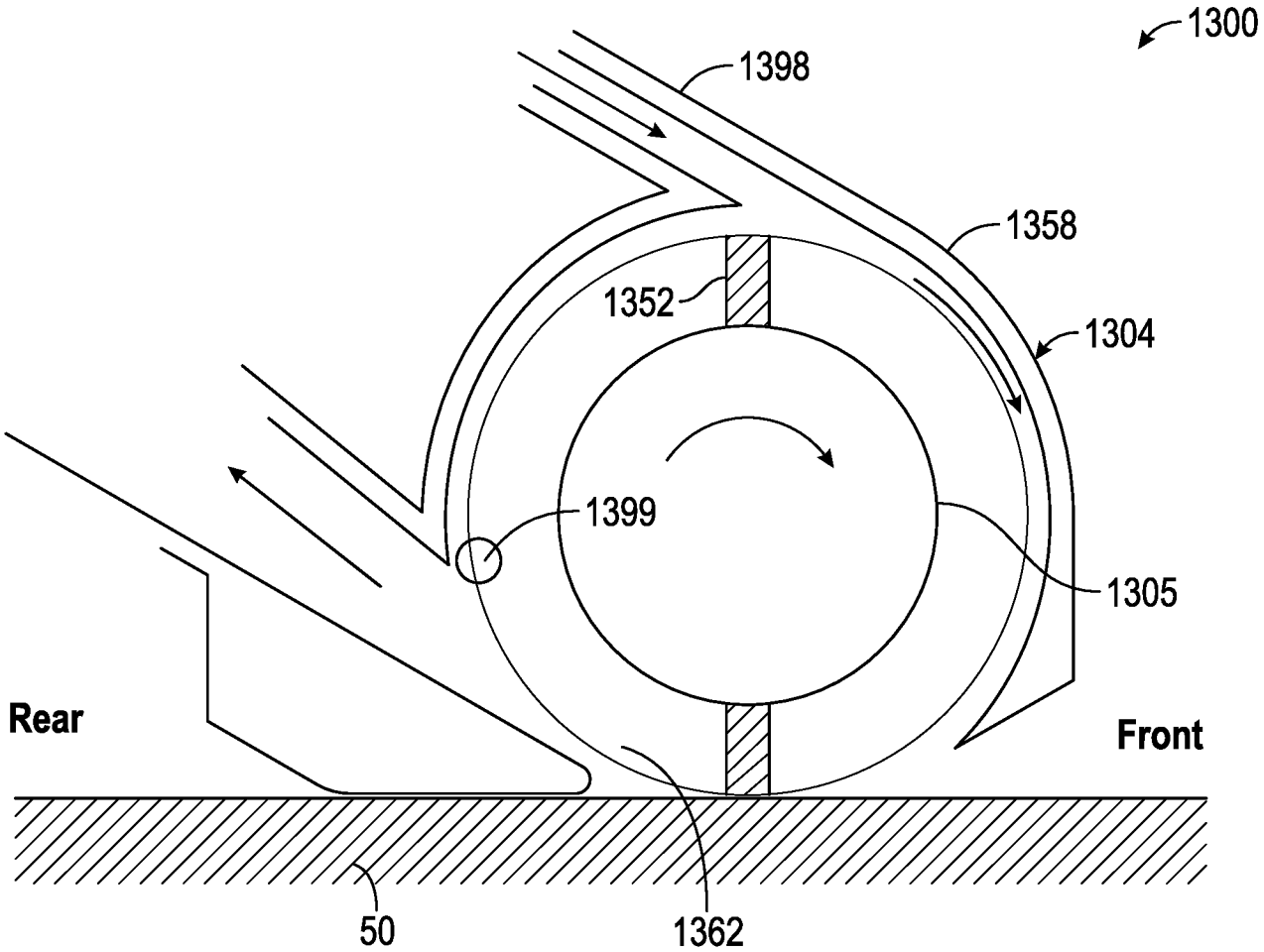
FIG. 13 illustrates a cross-sectional view of a portion of a mobile cleaning robot in an environment.

FIG. 13 illustrates a cross-sectional view of a cleaning assembly 1304 of a mobile cleaning robot 1300 in an environment. The cleaning assembly 1304 can be similar to the cleaning assemblies discussed above; the cleaning assembly 1304 can include an exhaust air discharge on one side of a roller and a suction inlet on an opposite side of the roller. Any of the robots discussed above or below can include the features of the mobile cleaning robot 1300.

The cleaning assembly 1304 can include a roller 1305 located at least partially within a roller housing 1358 and rotatable therein. The roller 1305 can include one or more fletches or bristles 1352 configured to engage the floor surface to help extract debris therefrom and into a debris port 1362 of the cleaning assembly 1304 and into a suction duct 1348.

The cleaning assembly 1304 can also include an exhaust port 1398 connected to an upper portion of the housing 1358 that can be configured to discharge exhaust air (such as from a vacuum system of the robot 1300 (e.g., the vacuum assembly 218)) near an upper portion of the roller 1305. The roller 1305 can optionally be a helical roller such that the fletches, vanes, or bristles 1352 can extend around a circumference of the roller 1305 as the fletches 1352 extend axially along the roller 1305.

Optionally, the cleaning assembly 1304 can include a bar 1399 (e.g., a beater bar) connected to the roller housing 1358. The bar 1399 can be located in the housing 1358 and located between the exhaust port 1398 and the debris port 1362. The bar 1399 can be configured to engage the bristles 1352 of the roller 1305 to help limit bypass of air from the exhaust port 1398 to the debris port 1362 (such as limiting short-cycling), and helping to force the air to go around a front of the roller 1305. Forcing the air flow around the top and front portion of the roller 1305 can help to increase debris ingestion through the debris port 1362, helping to improve cleaning efficiency of the cleaning assembly 1304. The bar 1399 can also help to separate debris from the bristles 1352 so that the debris can be ingested through the debris port 1362.

Figure 14B:
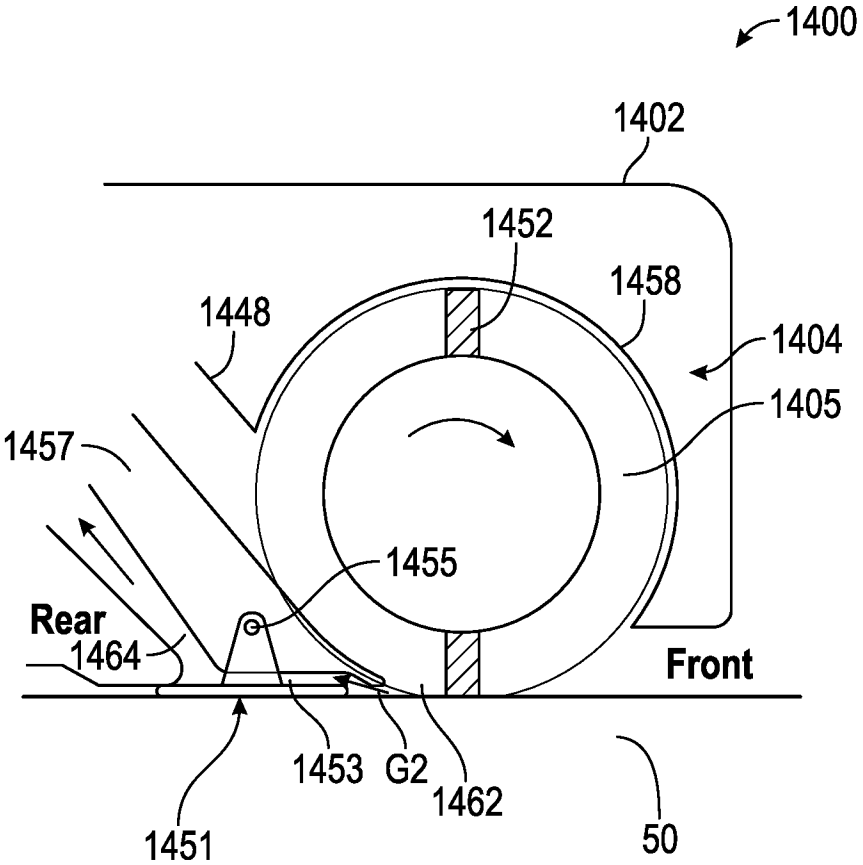
FIG. 14B illustrates a cross-sectional view of a portion of a mobile cleaning robot in an environment.
Figure 14A:
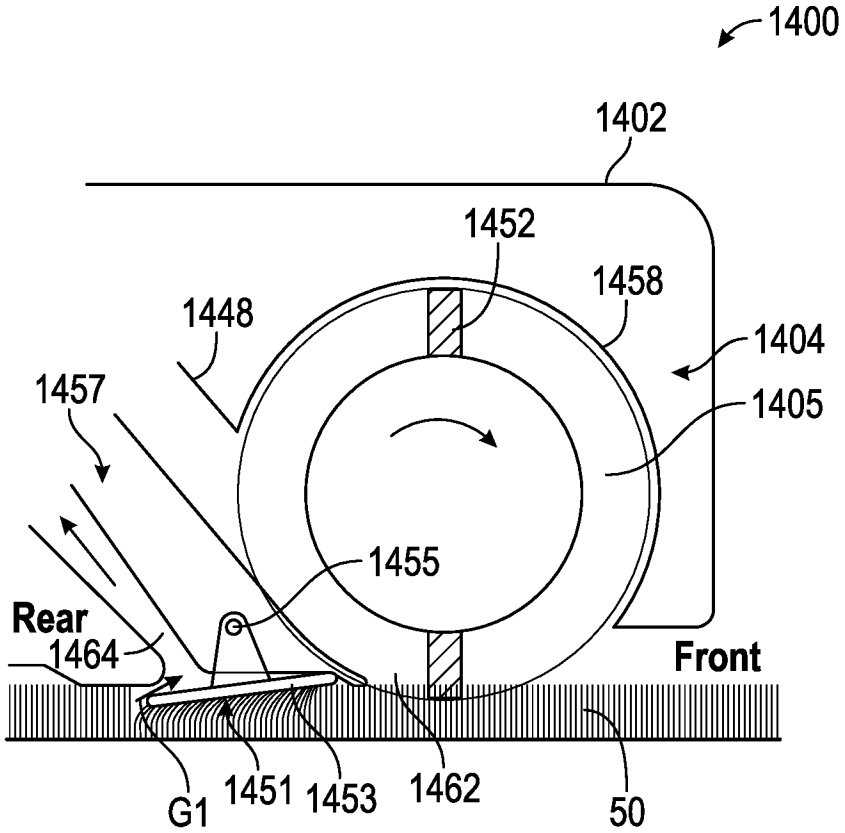
FIG. 14A illustrates a cross-sectional view of a portion of a mobile cleaning robot in an environment.

FIG. 14A illustrates a cross-sectional view of a cleaning assembly 1404 of a mobile cleaning robot 1400 in an environment. FIG. 14B illustrates a cross-sectional view of the cleaning assembly 1404 of the mobile cleaning robot mobile cleaning robot 1400 in the environment. FIGS. 14A and 14B are discussed together below. The cleaning assembly 1404 can be similar to the cleaning assemblies discussed above; the cleaning assembly 1404 can include a valve connected to the cleaning assembly near a debris port where the valve is movable based on a type of flooring surface the robot 1400 is traversing. Any of the robots discussed above or below can include the features of the mobile cleaning robot 1400.

The cleaning assembly 1404 can include a roller 1405 located at least partially within a roller housing 1458 and rotatable therein. The roller 1405 can include one or more fletches or bristles 1452 configured to engage the floor surface to help extract debris therefrom and into a first debris port 1462 of the cleaning assembly 1404 and into a suction duct 1448.

The cleaning assembly 1404 can include a valve 1451. The valve 1451 can include a body 1453 and a pivot 1455 connected to a portion 1457 of a body 1402 of the mobile cleaning robot 1400. The valve 1451 can be rotatable, movable, or pivotable about the pivot 1455 with respect to the portion 1457 and the body 1402 and, notably, with respect to a second debris port 1464. The valve 1451 can be connected to the portion 1457 near a rear portion of the roller 1405 or a rear portion the first debris port 1462.

In a first position, as shown in FIG. 14A, the valve body 1453 can be tilted or moved to open a gap G1 at a rear position of the valve 1451 to expose the first debris port 1462 to a rear portion of the valve 1451. At a second position, as shown in FIG. 14B, the valve body 1453 can be tilted or moved (or not moved that is, the valve 1451 can be biased to, or normally in, the position of FIG. 14B) to open a gap G2 at a front position of the valve 1451 to expose the first debris port 1462 to a front portion of the valve 1451.

In operation, when the valve body 1453 engages carpet fibers, the valve body 1453 can tilt to agitate or move the fibers to create a gap in the fibers. Tilt of the body 1453 can be limited by contact between the valve body 1453 and the body 1402 of the mobile cleaning robot 1400. The gap G1 can be configured (e.g., sized or shaped) to align with the gap in the fibers to extract debris therefrom.

When the valve 1451 is in the position shown in FIG. 14B, the second debris port 1464 can provide additional suction near the first debris port 1462 to help limit debris from bypassing the cleaning assembly 1404. In this way, the valve 1451 can help to improve cleaning efficiency or effectiveness on multiple types of flooring.

Optionally, the valve 1451 can include a biasing element (e.g., a spring) to bias the valve 1451 to the position shown in FIG. 14A, which can allow its rear edge to sink into soft carpet. When on hard floor, as shown in FIG. 14B, engagement between the floor surface 50 and the valve body 1453 can cause the valve body 1453 to be forced into the position shown in FIG. 14B. This can allow the valve 1451 to automatically adjust to the floor type without additional actuation.

Optionally, the valve 1451 can be controlled by a controller (e.g., the controller 212) and an actuator connected thereto such that the controller can move the valve 1451 based on a detected type of flooring as the mobile cleaning robot 1400 moves throughout an environment.

Figure 15:
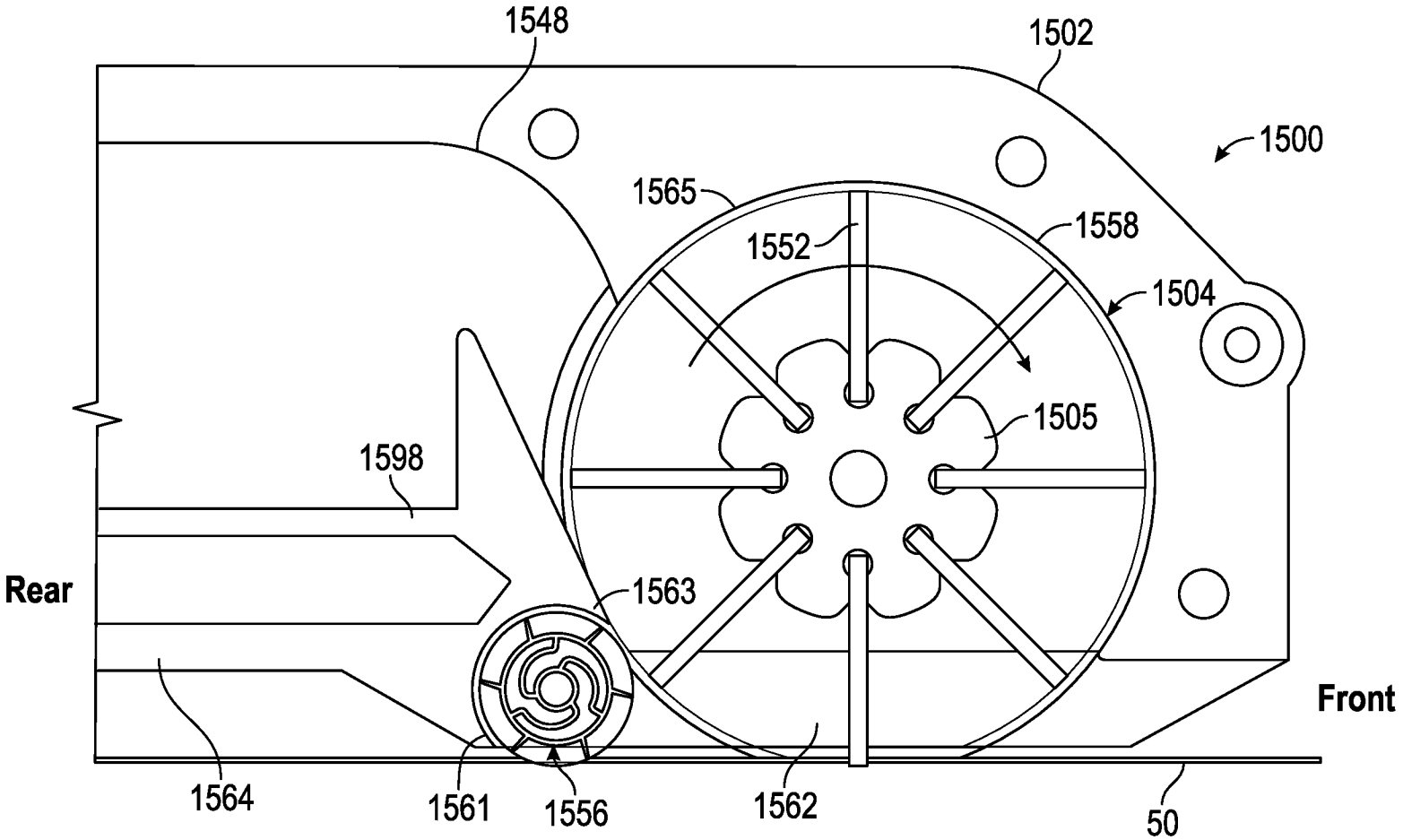
FIG. 15 illustrates a cross-sectional view of a portion of a mobile cleaning robot in an environment.

FIG. 15 illustrates a cross-sectional view of a cleaning assembly 1504 of a mobile cleaning robot 1500 in an environment. The cleaning assembly 1504 can be similar to the cleaning assemblies discussed above; the cleaning assembly 1504 can include a smaller roller at a rear portion of the cleaning assembly to help extract debris. Any of the robots discussed above or below can include the features of the mobile cleaning robot 1500.

The cleaning assembly 1504 can include a roller 1505 located at least partially within a roller housing 1558 and rotatable therein. The roller 1505 can include one or more fletches or bristles 1552 configured to engage the floor surface to help extract debris therefrom and into a first debris port 1562 of the cleaning assembly 1504 and into a suction duct 1548.

The cleaning assembly 1504 can also include a roller 1556 connected to the housing 1502 near a rear portion of the roller 1505. The roller 1556 can be configured to rotate therein to ingest debris from the floor surface 50 through an opening 1561 and into a second debris port 1564. Optionally, the roller 1556 can be configured to counter-rotate with respect to the roller 1505 to help move debris (such as large debris) that may pass the roller 1505 back toward the roller 1505 and into the first debris port 1562.

The cleaning assembly 1504 can also include an exhaust port 1598 that can be connected to a discharge of a vacuum system (e.g., the vacuum assembly 218) within the housing 1502 of the mobile cleaning robot 1500. The exhaust port 1598 can be configured to direct exhaust flow over a top and front portion of the roller 1556 and out an exhaust opening 1563, which can further help to move debris that may pass the roller 1505 back toward the roller 1505 and into the first debris port 1562, further helping to improve cleaning efficiency or effectiveness of the mobile cleaning robot 1500. The air moving through the exhaust opening 1563 can also help prevent debris from passing over top the roller 1556.

Optionally, air can be injected at opening 1561 to help direct debris back toward the roller 1505. Optionally, air can be injected at a top portion 1565 of the roller 1505 such as to help separate debris from the bristles 1552 and to help generate additional suction or motivation of debris through the second debris port 1564

Figure 16:
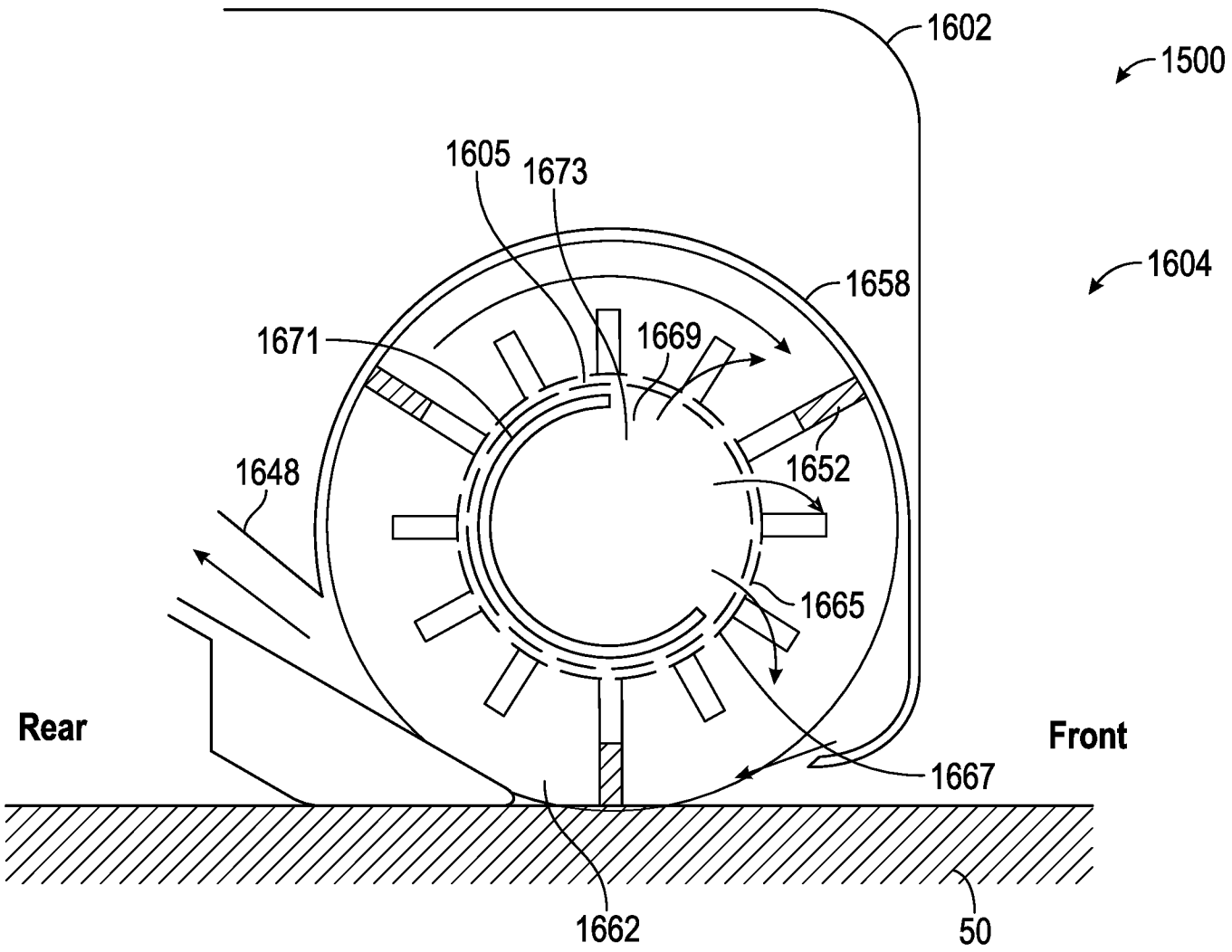
FIG. 16 illustrates a cross-sectional view of a portion of a mobile cleaning robot in an environment.

FIG. 16 illustrates a cross-sectional view of a cleaning assembly 1604 of a mobile cleaning robot 1600 in an environment. The cleaning assembly 1604 can be similar to the cleaning assemblies discussed above; the cleaning assembly 1604 can include a roller configured to discharge exhaust air to help extract debris from the environment. Any of the robots discussed above or below can include the features of the mobile cleaning robot 1600.

The cleaning assembly 1604 can include a roller 1605 located at least partially within a roller housing 1658 and rotatable therein. The roller 1605 can include one or more fletches or bristles 1652 configured to engage the floor surface to help extract debris therefrom and into a debris port 1662 of the cleaning assembly 1604 and into a suction duct 1648.

The roller 1605 can include a drum 1665 defining one or more bores 1667 extending therethrough. The drum 1665 can be connected to the bristles 1652 and can be rotatable therewith. The roller 1605 can also include an internal cavity 1669, which can be at least partially defined by the drum 1665 and can extend along at least a portion of a longitudinal axis of the roller 1605. The bores 1667 can extend from the cavity 1669 to an external portion of the 1665.

The roller 1605 can also include a wall 1671 within the drum 1665. The wall 1671 can be fixed relative to a body 1602 of the mobile cleaning robot 1600 and relative to the rotating drum 1665. The wall 1671 can also include an opening 1673 facing a front portion of the robot 1600 and closed to a rear portion of the robot. The internal cavity 1669 can be connected to a discharge of a vacuum system (e.g., the vacuum assembly 218) within the housing 1602 of the mobile cleaning robot 1600, such as to receive exhaust flow therefrom for discharge through the bores 1667.

In operation, when the cleaning assembly 1604 is in a cleaning mode, the roller 1605 can be rotating with respect to the cleaning assembly 1604 and exhaust flow can be delivered to the internal cavity 1669. The exhaust flow can be discharged from the internal cavity 1669 through the bores 1667 and out of a top and front portion of the roller 1605 along at least a portion of an axial length of the roller 1605. Optionally, exhaust air can be exhausted through one or more of the bristles 1652 (or fletches as discussed with respect to FIGS. 8-10).

Because the wall 1671 is closed to a rear portion of the roller 1605, though the roller 1605 rotates, the exhaust air is limited from exiting the bores at a rear portion of the roller 1605. The directionally controlled exhaust air can help to unclog the roller 1605 and can help to generate additional debris collection through the debris port 1662 and into the suction duct 1648.

Figure 17:
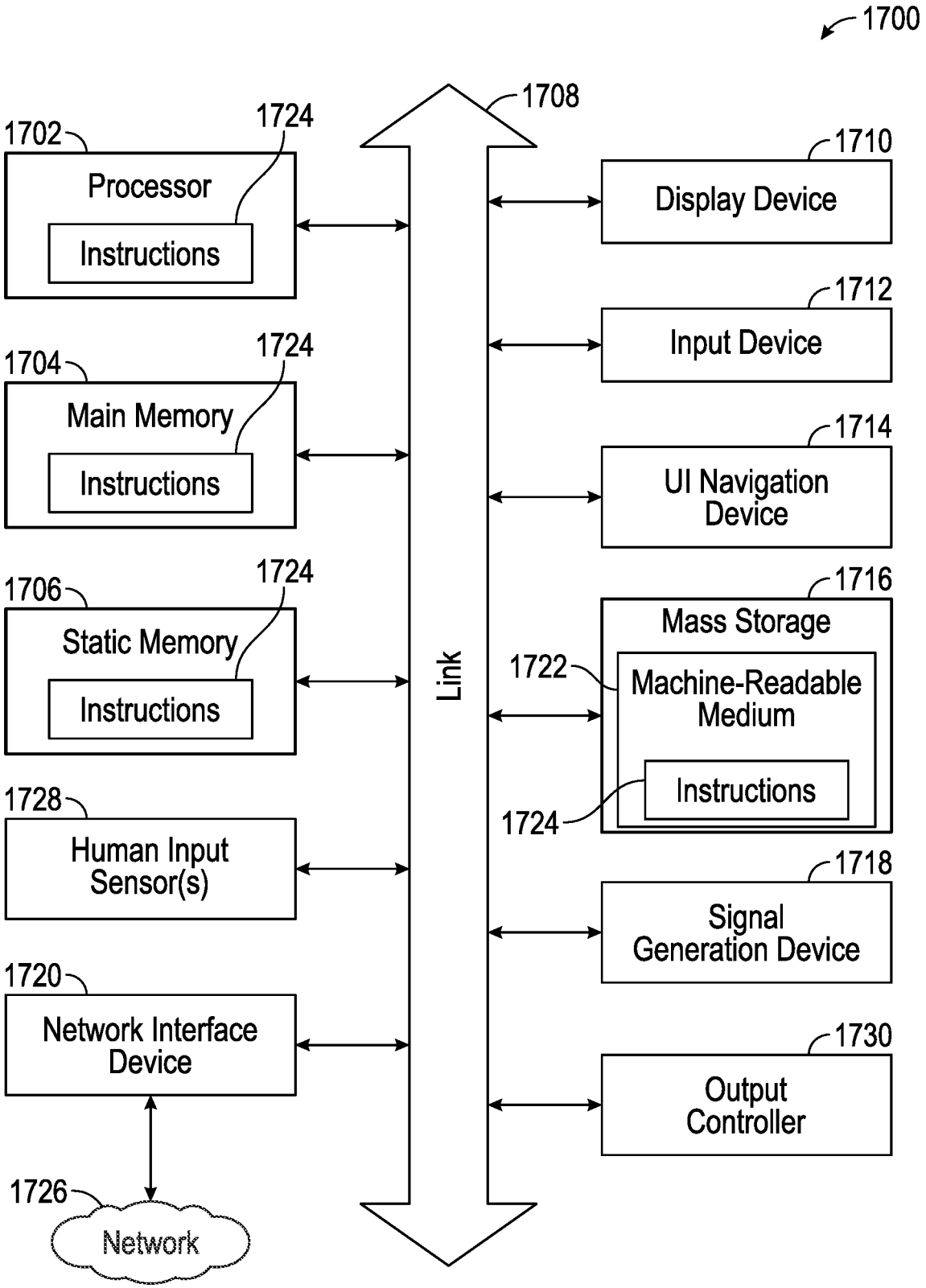
FIG. 17 illustrates a block diagram illustrating an example of a machine upon which one or more embodiments may be implemented.

FIG. 17 illustrates a block diagram of an example machine 1700 upon which any one or more of the techniques (e.g., methodologies) discussed herein may perform. Examples, as described herein, may include, or may operate by, logic or a number of components, or mechanisms in the machine 1700. Circuitry (e.g., processing circuitry) is a collection of circuits implemented in tangible entities of the machine 1700 that include hardware (e.g., simple circuits, gates, logic, etc.). Circuitry membership may be flexible over time. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a machine readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, in an example, the machine readable medium elements are part of the circuitry or are communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time. Additional examples of these components with respect to the machine 1700 follow.

In alternative embodiments, the machine 1700 may operate as a standalone device or may be connected (e.g., networked) to other machines. In a networked deployment, the machine 1700 may operate in the capacity of a server machine, a client machine, or both in server-client network environments. In an example, the machine 1700 may act as a peer machine in peer-to-peer (P2P) (or other distributed) network environment. The machine 1700 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

The machine (e.g., computer system) 1700 may include a hardware processor 1702 (e.g., a central processing unit (CPU), a graphics processing unit (GPU), a hardware processor core, or any combination thereof), a main memory 1704, a static memory (e.g., memory or storage for firmware, microcode, a basic-input-output (BIOS), unified extensible firmware interface (UEFI), etc.) 1706, and mass storage 1708 (e.g., hard drive, tape drive, flash storage, or other block devices) some or all of which may communicate with each other via an interlink (e.g., bus) 1730. The machine 1700 may further include a display unit 1710, an alphanumeric input device 1712 (e.g., a keyboard), and a user interface (UI) navigation device 1714 (e.g., a mouse). In an example, the display unit 1710, input device 1712 and UI navigation device 1714 may be a touch screen display. The machine 1700 may additionally include a storage device (e.g., drive unit) 1708, a signal generation device 1718 (e.g., a speaker), a network interface device 1720, and one or more sensors 1716, such as a global positioning system (GPS) sensor, compass, accelerometer, or other sensor. The machine 1700 may include an output controller 1728, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

Registers of the processor 1702, the main memory 1704, the static memory 1706, or the mass storage 1708 may be, or include, a machine readable medium 1722 on which is stored one or more sets of data structures or instructions 1724 (e.g., software) embodying or utilized by any one or more of the techniques or functions described herein. The instructions 1724 may also reside, completely or at least partially, within any of registers of the processor 1702, the main memory 1704, the static memory 1706, or the mass storage 1708 during execution thereof by the machine 1700. In an example, one or any combination of the hardware processor 1702, the main memory 1704, the static memory 1706, or the mass storage 1708 may constitute the machine readable media 1722. While the machine readable medium 1722 is illustrated as a single medium, the term "machine readable medium" may include a single medium or multiple media (e.g., a centralized or distributed database, and/or associated caches and servers) configured to store the one or more instructions 1724.

The term "machine readable medium" may include any medium that is capable of storing, encoding, or carrying instructions for execution by the machine 1700 and that cause the machine 1700 to perform any one or more of the techniques of the present disclosure, or that is capable of storing, encoding or carrying data structures used by or associated with such instructions. Non-limiting machine readable medium examples may include solid-state memories, optical media, magnetic media, and signals (e.g., radio frequency signals, other photon based signals, sound signals, etc.). In an example, a non-transitory machine readable medium comprises a machine readable medium with a plurality of particles having invariant (e.g., rest) mass, and thus are compositions of matter. Accordingly, non-transitory machine-readable media are machine readable media that do not include transitory propagating signals. Specific examples of non-transitory machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 1724 may be further transmitted or received over a communications network 1726 using a transmission medium via the network interface device 1720 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 1720 may include one or more physical jacks (e.g., Ethernet, coaxial, or phone jacks) or one or more antennas to connect to the communications network 1726. In an example, the network interface device 1720 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 1700, and includes digital or analog communications signals or other intangible medium to facilitate communication of such software. A transmission medium is a machine readable medium.

NOTES AND EXAMPLES

The following, non-limiting examples, detail certain aspects of the present subject matter to solve the challenges and provide the benefits discussed herein, among others.

Example 1 is a mobile cleaning robot comprising: a body movable within an environment; a debris bin located at least partially within the body; and a cleaning assembly connected to the body, the cleaning assembly including: a first debris port connected to the debris bin; and a second debris port connected to the debris bin.

In Example 2, the subject matter of Example 1 optionally includes a valve movable between an open position and a closed position to open and close at least one of the first debris port and the second debris port.

In Example 3, the subject matter of Example 2 optionally includes wherein the first debris port is connected to a cleaning head of the mobile cleaning robot, and the second debris port extends through a lower portion of the body laterally outward of the cleaning head.

In Example 4, the subject matter of any one or more of Examples 2-3 optionally include wherein the valve is located rearward of the first debris port.

In Example 5, the subject matter of Example 4 optionally includes wherein the valve is configured to engage a floor surface to move the valve to the open position.

In Example 6, the subject matter of any one or more of Examples 2-5 optionally include a vacuum system independently connected to the second debris port.

In Example 7, the subject matter of any one or more of Examples 1-6 optionally include an arm connected to the body and movable relative thereto between an extended position and a retracted position, the second debris port extending at least partially through the arm.

In Example 8, the subject matter of Example 7 optionally includes wherein the second debris port terminates closer to a cleaning assembly when the arm is in the extended position than when the arm is in the retracted position.

In Example 9, the subject matter of Example 8 optionally includes wherein the movable arm includes a fletch extending from a shaft of the arm, and wherein the second debris port extends at least partially through the fletch.

In Example 10, the subject matter of any one or more of Examples 1-9 optionally include a first debris chamber connected to the first debris port and connected to the debris bin; a second debris chamber connected to the first debris port and connected to the debris bin; and a divider separating the first debris chamber from the second debris chamber.

In Example 11, the subject matter of Example 10 optionally includes a door in the divider movable between an open position and a closed position, the door connecting the first debris chamber to the second debris chamber when the door is in the open position.

In Example 12, the subject matter of Example 11 optionally includes wherein the door is configured to move from the closed position to the open position when exposed to an evacuation suction pressure that is higher than a normal operating suction pressure.

In Example 13, the subject matter of any one or more of Examples 1-12 optionally include wherein the cleaning assembly includes a roller rotatable to extract debris from a floor surface and into at least one of the first debris port or the second debris port, and wherein an exhaust port extends at least partially through the roller.

In Example 14, the subject matter of Example 13 optionally includes wherein the roller includes a fletch extending radially from a core of the roller, the exhaust port extending at least partially through the fletch.

Example 15 is a method of operating a mobile cleaning robot, the method comprising: determining a floor type of a floor surface of an environment; determining a location of the mobile cleaning robot within the environment; and adjusting a first debris port and a second debris port of a cleaning assembly of the mobile cleaning robot.

In Example 16, the subject matter of Example 15 optionally includes detecting debris on the floor surface of the environment; determining a debris type of the detected debris; and adjusting at least one of the first debris port and the second debris port based on the debris type.

In Example 17, the subject matter of any one or more of Examples 15-16 optionally include wherein adjusting the at least one of the first debris port and the second debris port includes operating a valve between an open position and a closed position to open and close at least one of the first debris port and the second debris port.

In Example 18, the subject matter of Example 17 optionally includes wherein the valve is connected rearward of the first debris port.

In Example 19, the subject matter of any one or more of Examples 4-18 optionally include wherein the valve is configured to engage a floor surface to move the valve between the open position and the closed position.

In Example 20, the subject matter of any one or more of Examples 15-19 optionally include moving an arm connected to a body of the robot relative thereto between an extended position and a retracted position, the second debris port extending at least partially through the arm.

In Example 21, the subject matter of Example 20 optionally includes wherein the second debris port terminates closer to a cleaning assembly when the arm is in the extended position than when the arm is in the retracted position.

Example 22 is a non-transitory machine-readable medium including instructions, for operating a mobile cleaning robot, which when executed by a machine, cause the machine to: detect debris on a floor surface of an environment; determine a debris type of the detected debris; and adjust at least one of a debris port and a second debris port based on the debris type.

In Example 23, the apparatuses or method of any one or any combination of Examples 1-22 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot comprising:
- a body movable within an environment;
- a debris bin located at least partially within the body;
- a cleaning assembly connected to the body, the cleaning assembly including:
  - a cleaning head including one or more roller;
  - a first debris port associated with the cleaning head and connected to the debris bin by a first debris path; and
  - a second debris port connected to the debris bin by a second debris path, the second debris path separated from the first debris path; and
- a valve connected to the body in a location at least partially rearward of the one or more roller, the valve movable between an open position and a closed position to open and close the second debris port.

2. The mobile cleaning robot of claim 1, wherein the first debris port is connected to a cleaning head of the mobile cleaning robot, and the second debris port extends through a lower portion of the body laterally outward of the cleaning head.

3. The mobile cleaning robot of claim 1, wherein the valve is located rearward of the first debris port.

4. The mobile cleaning robot of claim 3, wherein the valve is configured to engage a floor surface to move the valve to the open position.

5. The mobile cleaning robot of claim 1, further comprising:
- a vacuum system independently connected to the second debris port.

6. The mobile cleaning robot of claim 1, further comprising:
- an arm connected to the body and movable relative thereto between an extended position and a retracted position, the second debris port extending at least partially through the arm.

7. The mobile cleaning robot of claim 6, wherein the second debris port terminates closer to a cleaning assembly when the arm is in the extended position than when the arm is in the retracted position.

8. The mobile cleaning robot of claim 7, wherein the movable arm includes a fletch extending from a shaft of the arm, and wherein the second debris port extends at least partially through the fletch.

9. The mobile cleaning robot of claim 1, further comprising:

a first debris chamber connected to the first debris port and connected to the debris bin;

a second debris chamber connected to the first debris port and connected to the debris bin; and a divider separating the first debris chamber from the second debris chamber.

10. The mobile cleaning robot of claim 9, further comprising:

a door in the divider movable between an open position and a closed position, the door connecting the first debris chamber to the second debris chamber when the door is in the open position.

11. The mobile cleaning robot of claim 10, wherein the door is configured to move from the closed position to the open position when exposed to an evacuation suction pressure that is higher than a normal operating suction pressure.

12. The mobile cleaning robot of claim 1, wherein the cleaning assembly includes a roller rotatable to extract debris from a floor surface and into at least one of the first debris port or the second debris port, and wherein an exhaust port extends at least partially through the roller.

13. The mobile cleaning robot of claim 12, wherein the roller includes a fletch extending radially from a core of the roller, the exhaust port extending at least partially through the fletch.

* * * * *